US007019730B2

(12) United States Patent
Tsuchiya

(10) Patent No.: US 7,019,730 B2
(45) Date of Patent: Mar. 28, 2006

(54) POWER SUPPLY CIRCUIT, OPERATIONAL AMPLIFIER CIRCUIT, LIQUID CRYSTAL DEVICE AND ELECTRONIC INSTRUMENT

(75) Inventor: Masahiko Tsuchiya, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/930,748

(22) Filed: Sep. 1, 2004

(65) Prior Publication Data

US 2005/0024358 A1 Feb. 3, 2005

Related U.S. Application Data

(62) Division of application No. 09/990,297, filed on Nov. 23, 2001.

(30) Foreign Application Priority Data

Dec. 20, 2000 (JP) ..... 2000-386670

(51) Int. Cl.
*G09G 3/36* (2006.01)

(52) U.S. Cl. ..... 345/98; 345/211; 330/253; 327/563

(58) Field of Classification Search ..... 315/169.1; 330/255, 253; 345/98, 211; 327/563
See application file for complete search history.

(56) References Cited

U.S. PATENT DOCUMENTS 5,668,710 A 9/1997 Caliboso et al.
5,822,028 A 10/1998 Miyawaki
5,909,146 A * 6/1999 Okada ..... 330/255
6,426,594 B1 * 7/2002 Ito ..... 315/169.1

FOREIGN PATENT DOCUMENTS

| | | |
|---|---|---|
| JP | 07-230073 | 8/1995 |
| JP | A-8-271856 | 10/1996 |
| JP | A-9-138390 | 5/1997 |
| JP | 10-161613 | 6/1998 |
| JP | 2000-111867 | 4/2000 |
| JP | A-2000-235173 | 8/2000 |
| JP | A-2000-330085 | 11/2000 |

OTHER PUBLICATIONS

U.S. Appl. No. 09/817,082, filed Mar. 27, 2001, Tsuchiya.

* cited by examiner

*Primary Examiner*—Kent Chang
(74) *Attorney, Agent, or Firm*—Oliff & Berridge, PLC

(57) ABSTRACT

An operational amplifier having a first step-up circuit in the power supply circuit generates a first stepped-up potential level obtained by stepping up a power-supply level with a ground level taken as a reference. A regulator circuit generates a center potential obtained by regulating the first stepped-up potential level by referring to a reference potential level with the ground level taken as a reference. A second step-up circuit generates a second stepped-up potential level obtained by stepping up the center potential with the ground level taken as a reference. A multipotential generating circuit generates a plurality of potential levels from a difference between the second stepped-up potential level and the center potential with the ground level taken as a reference, and supplies those potential levels to the panel of the liquid crystal device that is driven by an MLS driving scheme.

4 Claims, 13 Drawing Sheets

POWER SUPPLY CIRCUIT, OPERATIONAL AMPLIFIER CIRCUIT, LIQUID CRYSTAL DEVICE AND ELECTRONIC INSTRUMENT

This is a Divisional of application Ser. No. 09/990,297, filed Nov. 23, 2001. The entire disclosure of the prior application is hereby incorporated by reference in its entirety.

Japanese Patent Application No. 2000-386670, filed on Dec. 20, 2000, is herein incorporated by reference in its entirety.

TECHNICAL FIELD

The present invention relates to a power supply circuit, an operational amplifier circuit, a liquid crystal device and an electronic instrument.

BACKGROUND

Liquid crystal devices that are incorporated in recent electronic instruments, such as portable telephones, portable information terminals or game machines, are demanded of cost reduction and lower power consumption. In case of a passive matrix type liquid crystal device, those demands are fulfilled by a multi-line selection (hereinafter abbreviated as MLS) driving scheme.

According to the MLS driving scheme, plural lines of scan electrodes are selected at a time and potentials which have a given orthogonal relationship and correspond to a selected pattern are applied to the associated scan electrodes in each of fields constituting one frame. Similarly, potentials which correspond to a pattern of pixels that are turned on and off and a selected pattern of the scan electrodes are applied to the associated signal electrodes. This scheme can set the effective values of voltages to be applied to the individual electrodes to the required values without raising the potential levels to be applied.

SUMMARY

According to a first aspect of the present invention, there is provided a power supply circuit which generates a plurality of potentials, comprising:

a first step-up circuit connected to first and second power supply lines which supply first and second potentials, and the first step-up circuit supplying a third power supply line with a third potential stepped up based on a difference between the first and second potentials;

a potential regulating circuit which is connected to the first and third power supply lines and supplies a fourth power supply line with a fourth potential which is a constant potential generated based on a difference between the first and third potentials;

a second step-up circuit which is connected to the first and fourth power supply lines and supplies a fifth power supply line with a fifth potential stepped up based on a difference between the first and fourth potentials; and a multipotential generating circuit which is connected to the first, fourth and fifth power supply lines and generates a plurality of potentials based on differences among the first, fourth and fifth potentials.

According to a second aspect of the present invention, there is provided an operational amplifier circuit comprising:

a first conductivity type transistor having a gate to which a first differential output is supplied and a source to which a second potential is supplied;

a second conductivity type transistor having a gate to which a second differential output is supplied, a source to which a first potential is supplied and a drain which is connected to a drain of the first conductivity type transistor;

a first conductivity type differential amplifier circuit which generates the first differential output based on a difference between a given differential input potential and a potential at the drain of the first or second conductivity type transistor;

a second conductivity type differential amplifier circuit which generates the second differential output based on the difference between the differential input potential and the potential at the drain of the first or second conductivity type transistor;

a first current control circuit which controls a constant current value of the first conductivity type differential amplifier circuit based on the second differential output; and a second current control circuit which controls a constant current value of the second conductivity type differential amplifier circuit based on the first differential output.

DETAILED DESCRIPTION OF THE EMBODIMENTS

Figure 1:
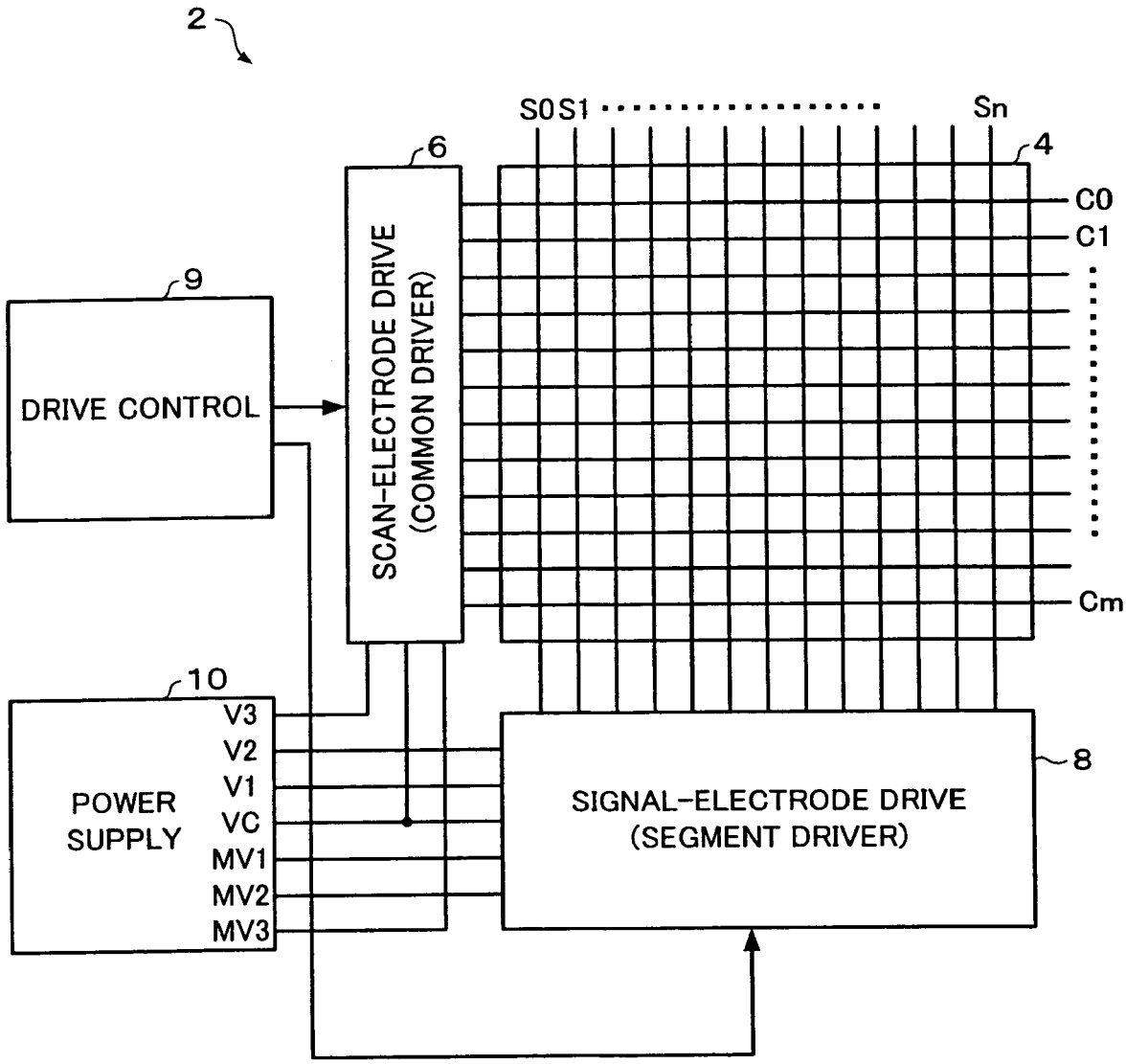
FIG. 1 is a schematic diagram illustrating the essential components of a liquid crystal device to which a power supply circuit according to one embodiment of the present invention is applied.

Embodiments of the present invention will now be described.

The embodiments to be described below are in no way restricting the contents of the present invention recited in the appended claims. In addition, not all the elements of the embodiments discussed below are essential to the invention.

In case where a liquid crystal device is driven by the MLS driving scheme, it is known that the optimal display driving is carried out based on the following equation (1)

$$L=(1/a-1)^2 \quad (1)$$

where L is the number of display lines and "a" is a bias ratio. The bias ratio is a ratio of the effective value of the voltage to be applied when the liquid crystal is on to the effective value of the voltage to be applied when the liquid crystal is off. In case where the bias ratio is 1/5, for example, the optimal number of display lines is sixteen.

Recently, the panels of liquid crystal devices become larger, and the number of display lines is increased accordingly. To acquire the optimal bias ratio from the equation (1), therefore, the number of potential levels needed to drive the liquid crystal tends to increase.

According to the MLS driving scheme, however, the potential levels to be applied to the scan electrodes and signal electrodes are determined based on a center potential VC. In case where a twin-well process that can lead to cost reduction is used, therefore, given that the center potential VC is a ground level VSS, the generation of potential levels equal to or lower than the center potential VC requires multiple external parts, which leads to a cost increase and raises a mounting problem.

Since the maximum potential level when the center potential VC is on the positive side has to be within a predetermined range of voltage which depends on a production process, such configuration cannot cope with future multipotential designs.

The embodiments of the present invention have been designed to cope with the above-described technical issues and can provide at a reduced cost a power supply circuit and an operational amplifier circuit which are capable of dealing with a multipotential level design and suitable for generating potentials for driving a liquid crystal, and a liquid crystal device and electronic instrument using such power supply circuits and operational amplifier circuit.

According to one embodiment of the present invention, there is provided a power supply circuit which generates a plurality of potentials, comprising:

- a first step-up (or booster) circuit connected to first and second power supply lines which supply first and second potentials, and the first step-up circuit supplying a third power supply line with a third potential stepped up (or boosted) based on a difference between the first and second potentials;
- a potential regulating circuit which is connected to the first and third power supply lines and supplies a fourth power supply line with a fourth potential which is a constant potential generated based on a difference between the first and third potentials;
- a second step-up (or booster) circuit which is connected to the first and fourth power supply lines and supplies a fifth power supply line with a fifth potential stepped up (or boosted) based on a difference between the first; and fourth potentials; and
- a multipotential generating circuit which is connected to the first, fourth and fifth power supply lines and generates a plurality of potentials based on differences among the first, fourth and fifth potentials.

In this configuration, the first step-up (or booster) circuit generates a third potential (e.g., a first stepped-up potential level VOUT) based on a difference between a first potential (e.g., a ground level VSS) and a second potential (e.g., a power-supply level VDD) and the potential regulating circuit generates a fourth potential (e.g., a center potential VC) based on a difference between the first and third potentials. The second step-up (or booster) circuit generates a fifth potential (e.g., a potential level V3) through a step-up process based on a difference between the first and fourth potentials, and the multipotential generating circuit generates a plurality of potential levels. Because only potentials on one side of the first potential (the positive side or the negative side) can be used, external parts are not needed to generate a plurality of potential levels, unlike in the related art. This leads to cost reduction of the apparatus and avoids problems relating to mounting. The potential regulating circuit does not require a withstand voltage characteristic with respect to the fifth potential, making it possible to avoid a reduction in reliability and sufficiently cope with the future multipotential designs.

In this power supply circuit, the multipotential generating circuit may supply the fourth potential as a center potential of a plurality of potentials supplied to a liquid crystal device.

The liquid crystal device may include a passive matrix type liquid crystal panel which is driven by, for example, the MLS driving scheme.

Since the fourth potential which is generated based on the first potential and is on one side of the first potential is supplied as a center potential of the plurality of potentials to be supplied to such a liquid crystal device, the power supply circuit according to this embodiment can provide a multipotential power to a liquid crystal device having a passive matrix type liquid crystal panel driven by, for example, the MLS driving scheme. This means that it is possible to provide a power supply circuit capable of maintaining a reduced cost and a high reliability even if the number of power source levels required by the liquid crystal device is increased as described above.

In the power supply circuit according to this embodiment of the present invention, at least one of the first and second step-up circuits may be a charge pump circuit including:

- first, second, third and fourth switch circuits connected in series between a step-up power supply line to which a stepped-up potential is supplied and one power supply line having a lower potential in two power supply lines connected to the at least one of the first and second step-up circuits;
- a capacitor connected in parallel to the second and third switch circuits when the second switch circuit is connected to the first switch circuit connected to the step-up power supply line, the third switch circuit is connected to the second switch circuit, and the fourth switch circuit is connected between the third switch circuit and the power supply line having a lower potential; and
- a timing-signal generating circuit which generates a drive signal for the first to fourth switch circuits in such a way that the first and third switch circuits and the second and fourth switch circuits are alternately switched on.

Although the first switch circuit is connected to the step-up power supply line, it may be connected to a power supply line having a lower potential in two power supply lines connected to the charge pump circuit. Specifically, when four switch circuits connected in series are named in the order a first switch circuit, a second switch circuit . . . and a fourth switch circuit, the capacitor has only to be connected in parallel to the second and third switch circuits.

In this case, at a first timing at which the first switch circuit connected to the step-up power supply line and the third switch circuit are on and the second and fourth switch circuits are off, for example, the path from the step-up power supply line is formed by the first switch circuit, the capacitor, the third switch circuit and a high-potential power supply line to be connected to the charge pump circuit. Therefore, the difference between the potential of the step-up power supply line and the potential of the high-potential power supply line described above is applied to the capacitor.

At a second timing at which the first switch circuit and the third switch circuit are off and the second and fourth switch circuits are on, the power supply path is formed by the high-potential power supply line, the second switch circuit, the capacitor, the fourth switch circuit and the low-potential power supply line. As a result, the difference between the potential of the high-potential power supply line and the potential of the low-potential power supply line is applied to the capacitor.

Based on the low-potential power supply line, therefore, the sum of the difference between the potential of the high-potential power supply line and the potential of the low-potential power supply line and the difference between the potential of the step-up power supply line and the potential of the high-potential power supply line is generated as a stepped-up (or boosted) potential.

In this way, the current consumption can be reduced by the switch circuits alone, and thus the power consumption of a power supply circuit also can be reduced.

In the power supply circuit according to this embodiment of the present invention, each of the first to fourth switch circuits may have a twin-well configuration comprising a first conductivity type well connected to the first power supply line and a second conductivity type well connected to the fifth power supply line.

Since the process can be performed with a low cost, the power supply circuit can be obtained with a reduced cost.

In this power supply circuit, the multipotential generating circuit may include:

- a first voltage dividing circuit which performs resistive division of a difference between the first and fourth potentials;
- a second voltage dividing circuit which performs resistive division of a difference between the fourth and fifth potentials;
- a first voltage-follower connected operational amplifier circuit which is connected to a potential obtained by resistive division performed by the first voltage dividing circuit; and
- a second voltage-follower connected operational amplifier circuit which is connected to a potential obtained by resistive division performed by the second voltage dividing circuit.

Since the voltage-follower connected operational amplifier circuit supplies a potential obtained by resistive division performed by the multipotential generating circuit, a power supply circuit which supplies stable potentials without a potential variation caused by a variation in load can be provided.

In the power supply circuit according to this embodiment of the present invention, the multipotential generating circuit may include:

- a first voltage-follower connected operational amplifier circuit which supplies a sixth potential and is connected to a potential obtained by resistive division of a difference between the first and fourth potentials;
- a second voltage-follower connected operational amplifier circuit which supplies a seventh potential and is connected to a potential obtained by resistive division of a difference between the fourth and fifth potentials;
- a first step-down (or debooster) circuit which generates an eighth potential generated by stepping-down (or deboosting) a difference between the fourth and sixth potentials; and
- a second step-down (or debooster) circuit which generates a ninth potential generated by stepping-down (or deboosting) a difference between the fourth and seventh potentials.

In this configuration, the first voltage-follower connected operational amplifier circuit is connected to a potential obtained by resistive division of the difference between the first and fourth potentials to provide the sixth potential, and the second voltage-follower connected operational amplifier circuit is connected to a potential obtained by resistive division of the difference between the fourth and fifth potentials to provide the seventh potential. The first step-down circuit generates the eighth potential based on the difference between the fourth and sixth potentials, and the second step-down circuit generates the ninth potential based on the difference between the fourth and seventh potentials. This design eliminates the need to use an operational amplifier circuit with large current consumption for each supply potential, thus reducing power consumption.

In the power supply circuit according to this embodiment of the present invention, the multipotential generating circuit may include:

- a first voltage-follower connected operational amplifier circuit which supplies a sixth potential and is connected to a potential obtained by resistive division of a difference between the first and fourth potentials or a difference between the fourth and fifth potentials;
- a third step-up circuit which generates a seventh potential generated by stepping-up a difference between the fourth and sixth potentials in a direction of the fourth potential;
- a first step-down circuit which generates an eighth potential generated by stepping-down a difference between the fourth and sixth potentials; and
- a second step-down circuit which generates a ninth potential generated by stepping-down a difference between the fourth and seventh potentials.

The step-up in a direction of the fourth potential means that when the fourth potential is higher than the sixth potential, the difference between the fourth potential and the sixth potential is stepped up based on the sixth potential, and alternatively, the difference between the fourth potential and the sixth potential is stepped up based on the fourth potential when the fourth potential is lower than the sixth potential, for example.

In this configuration, the first operational amplifier circuit performs resistive division of the difference between the first and fourth potentials or the difference between the fourth and fifth potentials and supplies the sixth potential. The third step-up circuit generates the seventh potential by stepping-up the difference between the fourth and sixth potentials in the direction of the fourth potential. The first and second step-down circuits respectively generate the eighth potential by stepping-down the difference between the fourth and sixth potentials and the ninth potential by stepping-down the difference between the fourth and seventh potentials. This can further reduce the number of operational amplifier circuits, enabling more effective reduction of the power consumption.

In the power supply circuit according to this embodiment of the present invention, one of the first and second operational amplifier circuits may include:

a first conductivity type transistor having a gate to which a first differential output is supplied and a source to which the second potential is supplied;

a second conductivity type transistor having a gate to which a second differential output is supplied, a source to which the first potential is supplied and a drain which is connected to a drain of the first conductivity type transistor;

a first conductivity type differential amplifier circuit which generates the first differential output based on a difference between the potential obtained by resistive division and a potential at the drain of the first or second conductivity type transistor;

a second conductivity type differential amplifier circuit which generates the second differential output based on a difference between the potential obtained by resistive division and the potential at the drain of the first or second conductivity type transistor;

a first current control circuit which controls a constant current value of the first conductivity type differential amplifier circuit based on the second differential output; and a second current control circuit which controls a constant current value of the second conductivity type differential amplifier circuit based on the first differential output.

In this configuration, the first current control circuit can control the gate voltage of the first conductivity type transistor by controlling the constant current value of the first conductivity type differential amplifier circuit based on the differential output of the second conductivity type differential amplifier circuit. The second current control circuit can control the gate voltage of the second conductivity type transistor by controlling the constant current value of the second conductivity type differential amplifier circuit based on the differential output of the first conductivity type differential amplifier circuit. Thus operations of the first and second conductivity type transistors can be speeded, resulting in a prompt transition of the output potential of the operational amplifier circuit to a stable state.

In this case, lower power consumption of the operational amplifier circuit can also be realized by setting the constant current values of the first and second differential amplifier circuits as small as possible and supplying the current of the optimal value only when the required stable output is provided.

In the first conductivity type differential amplifier circuit and the second conductivity type differential amplifier circuit of the power supply circuit according to this embodiment of the present invention, gates of transistors having different performances may be respectively supplied with the potential obtained by resistive division and the potential at the drain of the first or second conductivity type transistor.

Since the same current flows through a transistor which has a high current drive performance and a transistor which has a low current drive performance to vary the potential of the differential output, the gate-source voltage of the first or second conductivity type transistor can be lowered, thus enabling reduction of the current consumption.

According to one embodiment of the present invention, there is provided an operational amplifier circuit comprising:

a first conductivity type transistor having a gate to which a first differential output is supplied and a source to which a second potential is supplied;

a second conductivity type transistor having a gate to which a second differential output is supplied, a source to which a first potential is supplied and a drain which is connected to a drain of the first conductivity type transistor;

a first conductivity type differential amplifier circuit which generates the first differential output based on a difference between a given differential input potential and a potential at the drain of the first or second conductivity type transistor;

a second conductivity type differential amplifier circuit which generates the second differential output based on the difference between the differential input potential and the potential at the drain of the first or second conductivity type transistor;

a first current control circuit which controls a constant current value of the first conductivity type differential amplifier circuit based on the second differential output; and a second current control circuit which controls a constant current value of the second conductivity type differential amplifier circuit based on the first differential output.

In this operational amplifier circuit, the first current control circuit can control the gate voltage of the first conductivity type transistor by controlling the constant current value of the first conductivity type differential amplifier circuit based on the differential output of the second conductivity type differential amplifier circuit. The second current control circuit can control the gate voltage of the second conductivity type transistor by controlling the constant current value of the second conductivity type differential amplifier circuit based on the differential output of the first conductivity type differential amplifier circuit. Thus operations of the first and second conductivity type transistors can be speeded, resulting in a prompt transition of the output potential of the operational amplifier circuit to a stable state.

In this case, lower power consumption of the operational amplifier circuit can also be realized by setting the constant current values of the first and second differential amplifier circuits as small as possible and supplying the current of the optimal value only when the required stable output is provided.

In the first conductivity type differential amplifier circuit and the second conductivity type differential amplifier circuit of the operational amplifier circuit according to this embodiment of the present invention, gates of transistors having different performances may be respectively supplied with the potential obtained by resistive division and the potential at the drain of the first or second conductivity type transistor.

Since the same current flows through a transistor which has a high current drive performance and a transistor which has a low current drive performance to vary the potential of the differential output, the gate-source voltage of the first or second conductivity type transistor can be lowered, thus enabling reduction of the current consumption.

According to one embodiment of the present invention, there is provided another power supply circuit comprising:

a voltage dividing circuit which divides a given potential;

and the above-described operational amplifier circuit to which a potential divided by the voltage dividing circuit is supplied as the differential input potential.

This power supply circuit can output a stable potential without being affected by the output load and reduce the power consumption.

One embodiment of the present invention provides a liquid crystal device comprising:

any of the above-described power supply circuits;

a liquid crystal panel having a plurality of scan electrodes and a plurality of signal electrodes laid out in an intersecting manner;

a scan-electrode drive circuit which drives the scan electrodes upon reception of power from the power supply circuit; and a signal-electrode drive circuit which drives the signal electrodes upon reception of power from the power supply circuit.

One embodiment of the present invention provides an electronic instrument comprising the above-described liquid crystal device.

Because the liquid crystal device and electronic instrument according to the embodiments of the present invention has any of the above-described power supply circuits, reduction of the power consumption is enabled by the liquid crystal device, and they are particularly useful for portable electronic instruments.

These embodiments will be described below with reference to the accompanying drawings.

1. Liquid Crystal Device

FIG. 1 illustrates the essential components of a liquid crystal device 2 to which the power supply circuit according to the embodiments of the invention is applied.

The liquid crystal device 2 includes a passive matrix type liquid crystal panel 4. The liquid crystal panel 4 has a liquid crystal sealed between a first substrate on which scan electrodes C0 to Cm are formed and a second substrate on which signal electrodes S0 to Sn are formed. The intersection of a single scan electrode and a single signal electrode is a display pixel, and the liquid crystal panel 4 has (m+1)×(n+1) display pixels.

There may be a case where the scan electrodes are called common electrodes and the signal electrodes are called segment electrodes and a case where a scan-electrode drive circuit is called a common driver and a signal-electrode drive circuit is called a segment driver. Instead of the passive matrix liquid crystal panel, other types of liquid crystal panels, such as an active matrix type, can be used for the liquid crystal panel 4.

A scan-electrode drive circuit 6 applies a predetermined potential to the scan electrodes C0 to Cm formed on the liquid crystal panel 4. A signal-electrode drive circuit 8 applies a predetermined potential to the signal electrodes S0 to Sn formed on the liquid crystal panel 4.

The scan-electrode drive circuit 6 and signal-electrode drive circuit 8 are supplied with the aforementioned potentials from a power supply circuit 10 and selectively supply the predetermined potentials to the scan electrodes C0 to Cm and the signal electrodes S0 to Sn based on a signal from a drive control circuit 9.

The liquid crystal device 2 is driven based on a signal from a drive control circuit 9 in accordance with a pattern of pixels to be driven by an MLS driving scheme which selects four lines simultaneously. Based on a center potential VC, therefore, the power supply circuit 10 generates a plurality of potential levels as potential levels to be supplied to the scan electrodes C0 to Cm and the signal electrodes S0 to Sn. Those potential levels, seven (V3, V2, V1, VC, MV1, MV2 and MV3) in total, are generated on the positive side with a ground level VSS or a substrate level being MV3.

Figure 2:
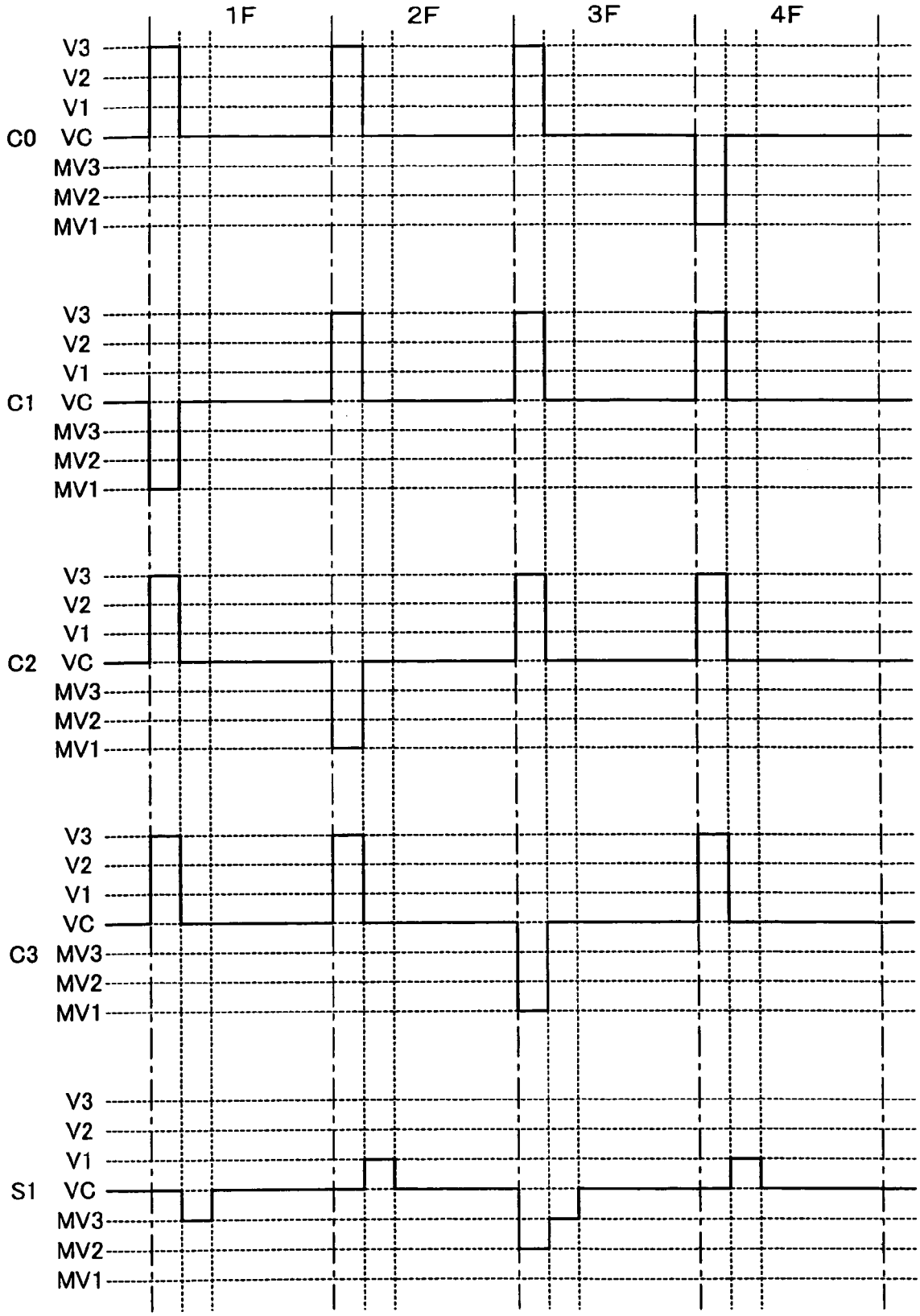
FIG. 2 is a waveform chart showing an example of drive waveforms in a liquid crystal panel shown in FIG. 1.

FIG. 2 shows one example of drive waveforms for the liquid crystal panel 4 shown in FIG. 1.

The shown drive waveforms are for the signal electrode S1 and the scan electrodes C0 to C3. One frame is divided into four fields and only eight lines of signal electrodes (for two clocks for each field) are shown while the other ones are omitted.

The scan-electrode drive circuit 6 supplies the scan electrodes C0 to C3 with the potentials of the pattern shown in the form of drive waveforms in FIG. 2. The signal-electrode drive circuit 8 supplies each signal electrode S1 with the potentials of the pattern shown in the form of drive waveforms in FIG. 2. Apparently, the MLS driving scheme that selects four lines simultaneously uses three levels of liquid crystal drive potentials V3, VC and MV3 for the scan electrodes C0 to C3. Similarly, five levels of liquid crystal drive potentials V2, V1, VC, MV1 and MV2 are used as a drive potential for the signal electrode S1.

Each pixel of the liquid crystal panel 4 is turned on or off by the effective value of the potential difference between the intersecting scan electrode and signal electrode in one frame period. FIG. 2 illustrates the drive waveforms in case where the pixels at the intersections of the signal electrode S1 and the scan electrodes C0 and C2 are on and the pixel at the intersection of the signal electrode S1 and the scan electrode C3 is off.

2. Power Supply Circuit

Figure 3:
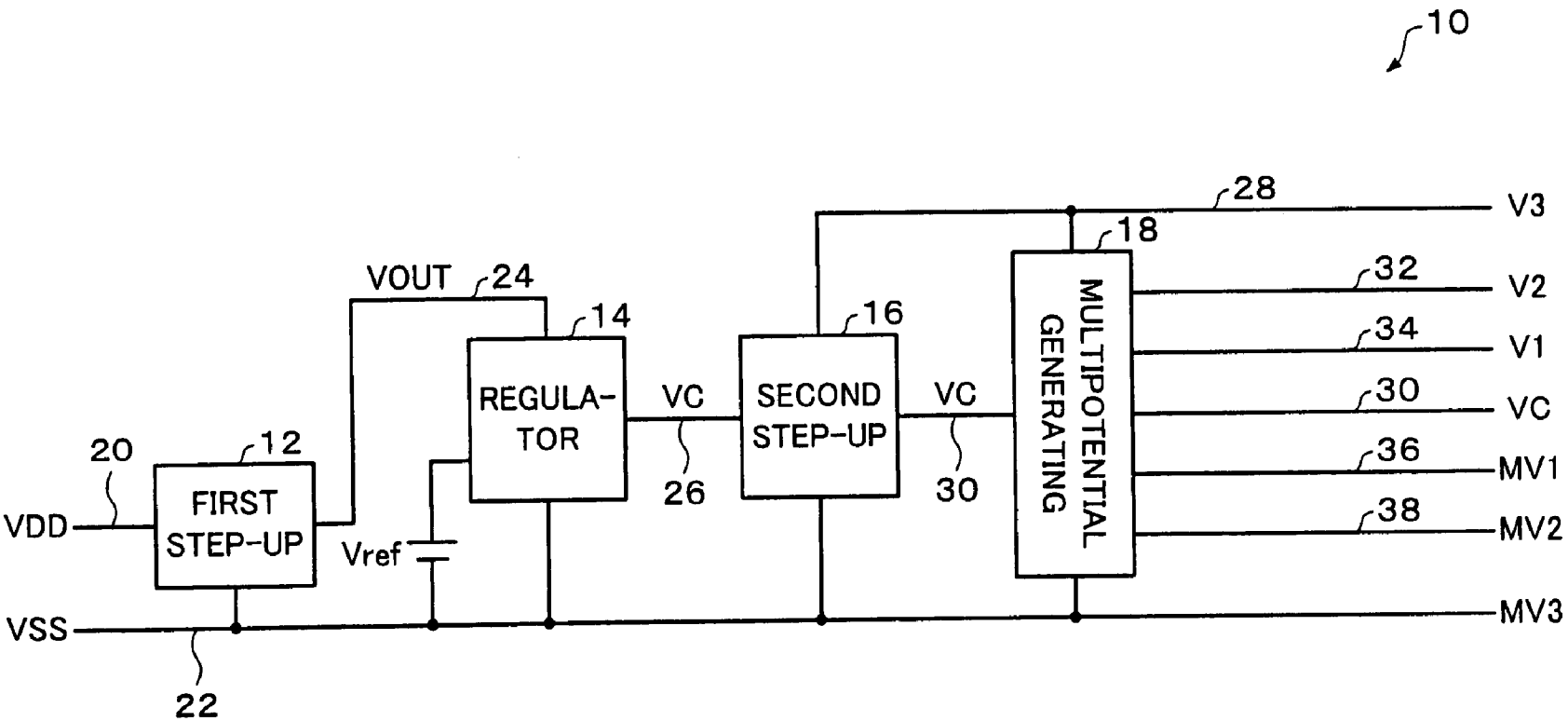
FIG. 3 schematically illustrates a structure of the power supply circuit according to one embodiment of the present invention.

FIG. 3 schematically illustrates the structure of the power supply circuit shown in FIG. 1.

The power supply circuit 10 includes a first step-up (or booster) circuit 12, a regulator circuit 14 as potential regulating means, a second step-up (or booster) circuit 16 and a multipotential generating circuit 18.

Figure 4:
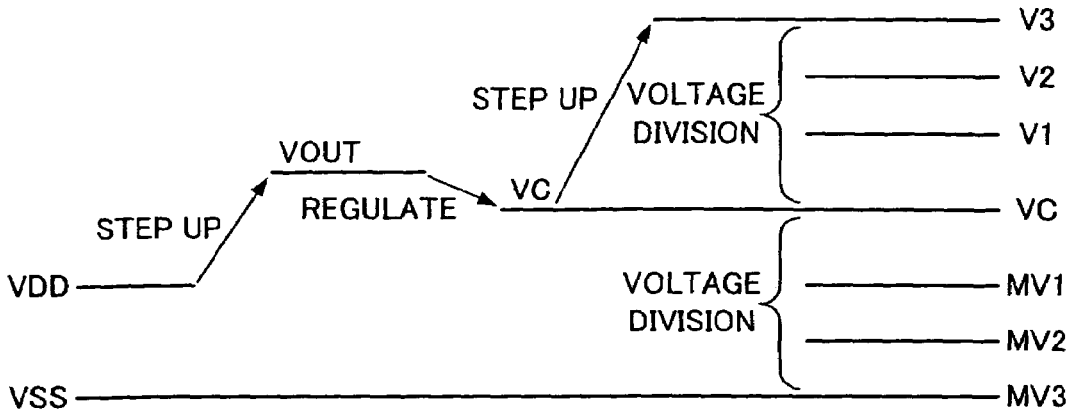
FIG. 4 schematically shows operations of the power supply circuit according to one embodiment of the present invention.

FIG. 4 schematically shows the operation of the power supply circuit shown in FIG. 3.

The first step-up circuit 12 in the power supply circuit 10 is connected with a supply-voltage potential supply line 20 to which a power-supply level VDD is supplied, a ground potential supply line 22 to which a ground level VSS is supplied, and a first potential supply line 24. The first step-up circuit 12 supplies the first potential supply line 24 with a first stepped-up potential level VOUT which is the power-supply level VDD stepped up based on the ground level VSS.

The regulator circuit (potential regulating means in a broad sense) 14 is connected with the ground potential supply line 22, the first potential supply line 24 and a second potential supply line 26. The regulator circuit 14 supplies the second potential supply line 26 with the center potential VC obtained by regulating the first stepped-up potential level VOUT supplied from the first step-up circuit 12 based on the ground level VSS by referring a reference potential level Vref. More specifically, the regulator circuit 14 generates the center potential VC, which is a regulatable constant potential level lower than the first stepped-up potential level VOUT, from this potential level VOUT.

The second step-up circuit 16 is connected with the ground potential supply line 22, the second potential supply line 26 and a first liquid-crystal drive potential supply line 28. Based on the ground level VSS, the second step-up circuit 16 supplies the first liquid-crystal drive potential supply line 28 with the potential level V3 which is acquired by stepping up the center potential VC regulated by the regulator circuit 14. The second step-up circuit 16 supplies center potential VC as it is to the multipotential generating circuit 18 via a center potential supply line 30.

The multipotential generating circuit 18 is connected with the ground potential supply line 22, the center potential supply line 30 and first to fifth liquid-crystal drive potential supply lines 28, 32, 34, 36 and 38. Based on the ground level VSS, the multipotential generating circuit 18 respectively supplies the second to fifth liquid-crystal drive potential supply lines 32, 34, 36 and 38 with the potential levels V2, V1, MV1 and MV2 that have been generated from the potential difference between the potential level V3 from the second step-up circuit 16 and the center potential VC. Those potential levels V2, V1, MV1 and MV2 correspond to the bias ratio which is determined in accordance with the number of display lines of the panel of the liquid crystal device that is driven by the MLS driving scheme. The multipotential generating circuit 18 generates the individual potential levels by voltage-dividing or stepping down the potential difference between the potential level V3 and the center potential VC, the center potential VC and the ground level VSS (MV3), for example, as shown in FIG. 4.

In this manner, the power supply circuit generates seven potential levels (V3, V2, V1, VC, MV1, MV2 and MV3).

In case where the twin-well process that can lead to cost reduction is used, therefore, external parts are not required, the cost of the apparatus is reduced and no mounting problem arises. Further, the regulator circuit 14 does not need a withstand voltage characteristic with respect to the potential level V3, avoids a reduction in reliability and can sufficiently cope with the future multipotential designs.

The following specifically discusses the essential structural portions of the power supply circuit.

2.1 First Step-Up (or Booster) Circuit

Figure 5:
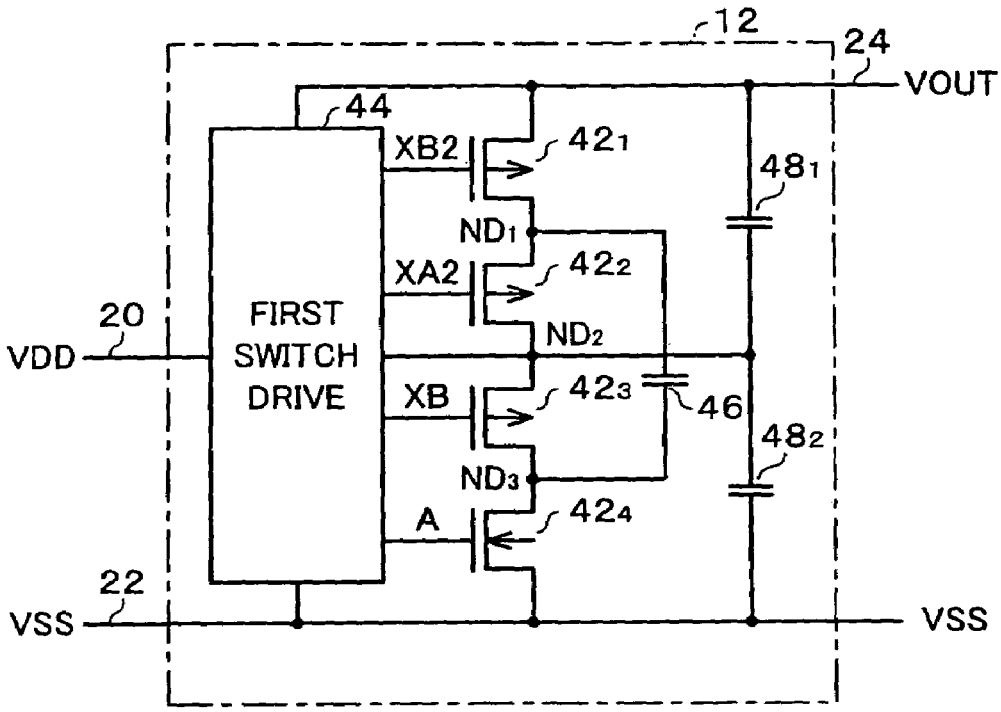
FIG. 5 shows an example of a structure of a first step-up circuit according to one embodiment of the present invention.

FIG. 5 shows one example of the structure of the first step-up circuit.

The first step-up (or booster) circuit 12 is a charge pump circuit which generates a potential level higher than the center potential VC that is supplied to a liquid crystal device by double boosting.

More specifically, the first step-up circuit 12 includes first to fourth switch circuits $\mathbf{42}_1$ to $\mathbf{42}_4$ connected in series between the first potential supply line 24 and the ground potential supply line 22, and a first switch drive circuit 44 which turns on or off the first to fourth switch circuits $\mathbf{42}_1$ to $\mathbf{42}_4$. Although the first step-up circuit 12 includes the first switch drive circuit 44, such a design is not restrictive. For example, the individual switch drive signals generated by the first switch drive circuit 44 may be externally supplied to the first to fourth switch circuits $\mathbf{42}_1$ to $\mathbf{42}_4$.

Given that $ND_1$ to $ND_3$ are nodes between the first to fourth switch circuits $\mathbf{42}_1$ to $\mathbf{42}_4$, the first step-up circuit 12 includes a capacitor 46 connected between $ND_1$ and $ND_3$, a capacitor $\mathbf{48}_1$ connected between the first potential supply line 24 and $ND_2$, and a capacitor $\mathbf{48}_2$ connected between $ND_2$ and the first potential supply line 22.

The first switch drive circuit 44 drives the first to fourth switch circuits $\mathbf{42}_1$ to $\mathbf{42}_4$ in such a way that the ON duration of the first and third switch circuits $\mathbf{42}_1$ and $\mathbf{42}_3$ and the ON duration of the second and fourth switch circuits $\mathbf{42}_2$ and $\mathbf{42}_4$ are alternately repeated.

In the following description, the first to third switch circuits $\mathbf{42}_1$ to $\mathbf{42}_3$ shown in FIG. 5 will be explained as p-type (first conductivity type) Metal Oxide Semiconductor (MOS) transistors (each of which will hereinafter simply be called "transistor") and the fourth switch circuit $\mathbf{42}_4$ connected to the ground level VSS is an n-type (second conductivity type) transistor. But, the embodiments of the present invention are not restricted to this design but any circuit that has a switching capability can be used for those switch circuits.

Figure 6:
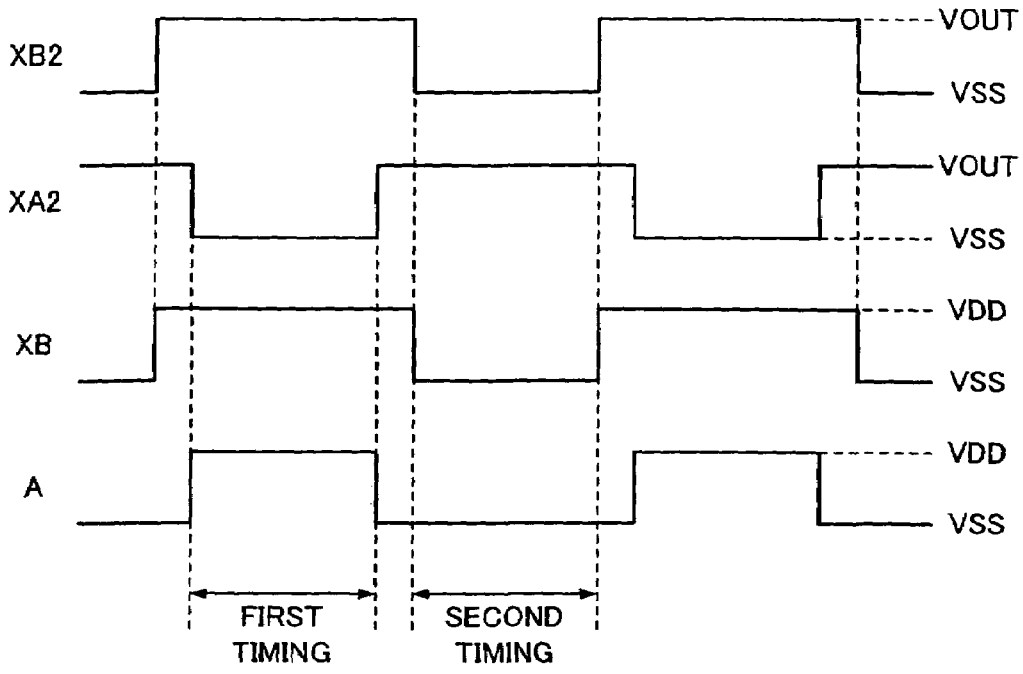
FIG. 6 is a waveform chart showing examples of switch drive signals generated by a first switch drive circuit according to one embodiment of the present invention.

FIG. 6 shows one example of individual switch drive signals that are generated by the first switch drive circuit 44.

Let XB2 be the switch drive signal to be supplied to the gate electrode of the p-type transistor of the first switch circuit $\mathbf{42}_1$, XA2 be the switch drive signal to be supplied to the gate electrode of the p-type transistor of the second switch circuit $\mathbf{42}_2$, XB be the switch drive signal to be supplied to the gate electrode of the p-type transistor of the third switch circuit $\mathbf{42}_3$, and A be the switch drive signal to be supplied to the gate electrode of the n-type transistor of the fourth switch circuit $\mathbf{42}_4$.

The individual switch drive signals have a non-overlapping period provided therein in such a way that the switch circuits connected to one another are not switched on simultaneously. This breaks the through path from the first potential supply line 24 to the ground potential supply line 22, thereby reducing the consumed current.

At the first timing shown in FIG. 6, the first and third switch circuits $\mathbf{42}_1$ and $\mathbf{42}_3$ are switched off and the second and fourth switch circuits $\mathbf{42}_2$ and $\mathbf{42}_4$ are switched on. Therefore, the capacitor $\mathbf{48}_1$ connected between the first potential supply line 24 and $ND_2$ and the capacitors 46 and $\mathbf{48}_2$ connected in parallel between $ND_2$ and the ground potential supply line 22 are connected in series.

At the second timing shown in FIG. 6, the first and third switch circuits $\mathbf{42}_1$ and $\mathbf{42}_3$ are switched on and the second and fourth switch circuits $\mathbf{42}_2$ and $\mathbf{42}_4$ are switched off. Therefore, the capacitors 46 and $\mathbf{48}_1$ connected in parallel between the first potential supply line 24 and $ND_2$ and the capacitor $\mathbf{48}_2$ connected between the ground potential supply line 22 and $ND_2$ are connected in series.

Through the switching operations of the first to fourth switch circuits $\mathbf{42}_1$ to $\mathbf{42}_4$ caused by the first switch drive circuit 44, the connection of the capacitor 46 to the capacitors $\mathbf{48}_1$ and $\mathbf{48}_2$ alternately and repeatedly changes between series connection and parallel connection. Accordingly, the charges to be stored in the capacitors 46, $\mathbf{48}_1$ and $\mathbf{48}_2$ become stable so that the values of the voltages to be applied to both ends of the individual capacitors 46, $\mathbf{48}_1$ and $\mathbf{48}_2$ become equal to one another.

With $ND_2$ fixed to the power-supply level VDD, therefore, the first stepped-up potential level VOUT supplied to the first potential supply line 24 becomes twice the power-supply level VDD based on the ground level VSS.

According to such a charge pump circuit, the capacitors 46, $\mathbf{48}_1$ and $\mathbf{48}_2$ restrict the consumed current to the switching currents of the first to fourth switch circuits $\mathbf{42}_1$, to $\mathbf{42}_4$, so that the consumed current can be reduced. Regardless of the capacitances of the capacitors 46, $\mathbf{48}_1$ and $\mathbf{48}_2$, the switching operations can accurately step up the first stepped-up potential level VOUT twice as high as the power-supply level VDD.

Although the foregoing description has been given of the charge pump circuit that performs double boosting, the embodiments of the present invention are not limited to this particular type. While the first step-up circuit 12 is preferably a charge pump circuit, any circuit may be used as long as the circuit can generate the first stepped-up potential level VOUT higher than the center potential VC that should be supplied to the liquid crystal device.

In case where precision is not demanded, the first step-up circuit 12 shown in FIG. 5 can execute similar double boosting even if the capacitors $\mathbf{48}_1$ and $\mathbf{48}_2$ are omitted.

2.2 Regulator Circuit

Figure 7:
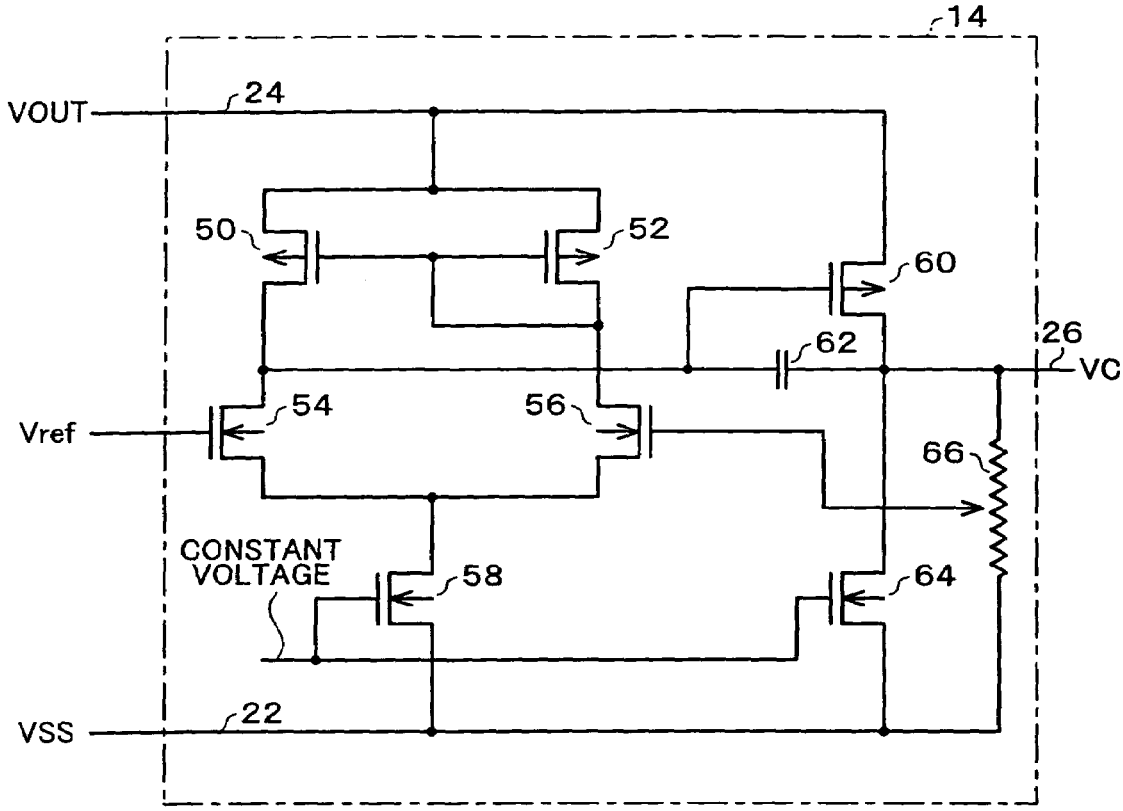
FIG. 7 is a circuit diagram showing a structure of a regulator circuit according to one embodiment of the present invention.

FIG. 7 shows an example of a structure of the regulator circuit according to the embodiments of the present invention.

The regulator circuit 14 includes a p-type (first conductivity type) differential amplifier circuit.

More specifically, the regulator circuit 14 includes p-type transistors 50 and 52 which have sources connected to the first potential supply line 24 and gate electrodes connected to each other, and n-type transistors 54 and 56 whose drains are connected to the drains of the p-type transistors 50 and 52. The gate electrodes of the p-type transistors 50 and 52 are connected to the drain of the p-type transistor 52 and constitute a current mirror circuit by both transistors. The reference potential level Vref is supplied to the gate electrode of the n-type transistor 54. The sources of the n-type transistors 54 and 56 are connected to the drain of an n-type transistor 58 whose gate electrode is applied with a constant voltage. The source of the n-type transistor 58 is connected to the ground potential supply line 22. That is, the n-type transistor 58 serves as a current source corresponding to the potential difference between the center potential VC and the ground level VSS.

The node between the drain of the p-type transistor 50 and the drain of the n-type transistor 54 is connected to the gate electrode of a p-type transistor 60 whose source is connected to the first potential supply line 24. This node is also connected to the second potential supply line 26 via an oscillation preventing capacitor 62. The drain of the p-type transistor 60 is connected to the second potential supply line 26.

The second potential supply line 26 is also connected to the drain of an n-type transistor 64 whose gate electrode is applied with a constant voltage. The source of the n-type transistor 64 is connected to the ground potential supply line 22. That is, the n-type transistor 64 serves as a current source corresponding to the potential difference between the center potential VC and the ground level VSS.

A resistor element 66 which can perform resistive division at an arbitrary ratio is connected between the second potential supply line 26 and the ground potential supply line 22. A potential obtained by resistive division by the resistor element 66 is applied to the gate electrode of the n-type transistor 56.

Such a feedback structure applies the potential corresponding to the difference between the reference potential level Vref of the n-type transistors 54 and 56 and the resistive-division originated potential level to the gate electrode of the p-type transistor 60.

When the resistive-division originated potential level becomes higher than the reference potential level Vref, the difference between those potential levels is amplified, thus raising the potential of the gate electrode of the p-type transistor 60. This reduces the current supplying performance of the p-type transistor 60. As a result, the center potential VC becomes lower and the resistive-division originated potential level drops too.

When the resistive-division originated potential level becomes lower than the reference potential level Vref, on the other hand, the difference between those potential levels is amplified, thus dropping the potential of the gate electrode of the p-type transistor 60. This enhances the current supplying performance of the p-type transistor 60. As a result, the center potential VC becomes higher and the resistive-division originated potential level rises too.

In view of the above phenomenon, the regulator circuit 14 generates the center potential VC in such a way that the reference potential level Vref becomes equal to the resistive-division originated potential. In this case, when a load to be connected to the second potential supply line 26 changes, the center potential VC can be generated. What is more, the center potential VC can be altered by changing the resistive-division originated potential level by the resistor element 66.

2.3 Second Step-Up Circuit 2.3.1 Structural Example

Figure 8:
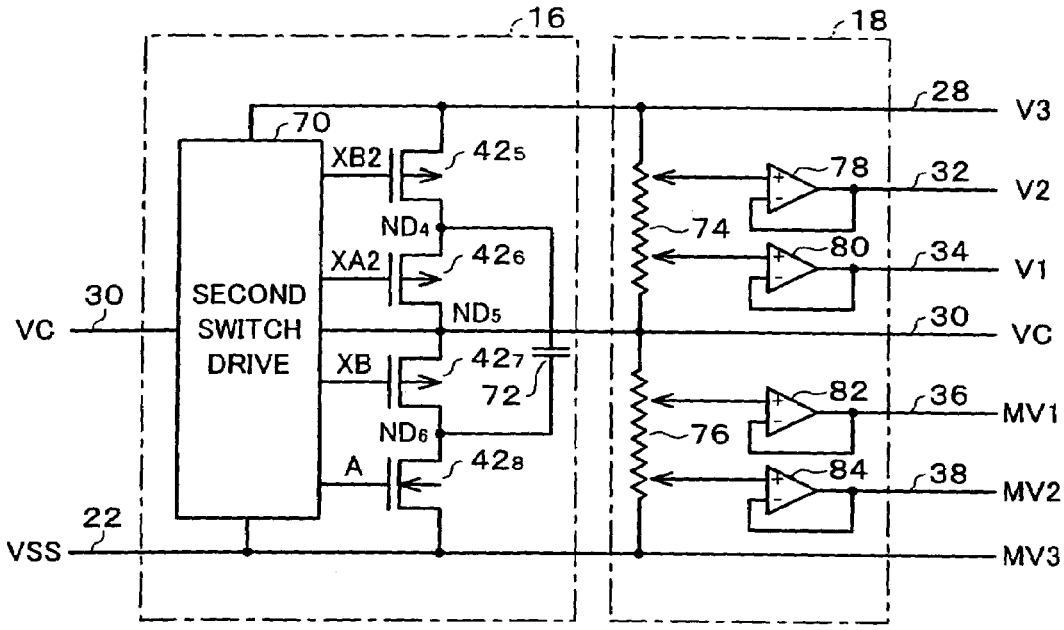
FIG. 8 shows a structures of a second step-up circuit and multipotential generating circuit according to one embodiment of the present invention.

FIG. 8 shows an example of a structures of the second step-up circuit and the multipotential generating circuit according to the embodiments of the present invention.

The second step-up circuit 16 is a charge pump circuit which generates a potential level twice as high as the center potential VC based on the ground level VSS.

More specifically, the second step-up circuit 16 includes fifth to eighth switch circuits $\mathbf{42}_5$ to $\mathbf{42}_8$ connected in series between the first liquid-crystal drive potential supply line 28 and the ground potential supply line 22, and a second switch drive circuit 70 which turns on or off the fifth to eighth switch circuits $\mathbf{42}_5$ to $\mathbf{42}_8$. Although the second step-up circuit 16 includes the second switch drive circuit 70, such a design is not restrictive. For example, the individual switch drive signals generated by the second switch drive circuit 70 may be externally supplied to the fifth to eighth switch circuits $\mathbf{42}_5$ to $\mathbf{42}_8$.

Given that $ND_4$ to $ND_6$ are nodes between the fifth to eighth switch circuits $\mathbf{42}_5$ to $\mathbf{42}_8$, the second step-up circuit 16 includes a capacitor 72 connected between $ND_4$ and $ND_6$.

The second switch drive circuit 70, like the first switch drive circuit 44 shown in FIG. 5, drives the fifth to eighth switch circuits $\mathbf{42}_5$ to $\mathbf{42}_8$ in such a way that the ON duration of the fifth and seventh switch circuits $\mathbf{42}_5$ and $\mathbf{42}_7$ and the ON duration of the sixth and eighth switch circuits $\mathbf{42}_6$ and $\mathbf{42}_8$ are alternately repeated.

In FIG. 8 as in FIG. 5, the fifth to seventh switch circuits $\mathbf{42}_5$ to $\mathbf{42}_7$ are illustrated as p-type (first conductivity type) transistors and the eighth switch circuit $\mathbf{42}_8$ connected to the ground level VSS is an n-type (second conductivity type) transistor. But, the embodiments of the present invention are not restricted to this design but any circuit that has a switching capability can be used for those switch circuits.

As individual switch drive signals that are generated by the second switch drive circuit 70 are the same as those generated by the first switch drive circuit 44 shown in FIG. 6, their description will not be repeated.

At the first timing, the fifth and seventh switch circuits $\mathbf{42}_5$ and $\mathbf{42}_7$ are switched off and the sixth and eighth switch circuits $\mathbf{42}_6$ and $\mathbf{42}_8$ are switched on. Therefore, one end of the capacitor 72 is electrically disconnected from the first liquid-crystal drive potential supply line 28 and connected to the center potential supply line 30 via the sixth switch circuit $\mathbf{42}_6$. The other end of the capacitor 72 is connected to the ground potential supply line 22 via the eight switch circuit $\mathbf{42}_8$.

At the second timing, the fifth and seventh switch circuits $\mathbf{42}_5$ and $\mathbf{42}_7$ are switched on and the sixth and eighth switch circuits $\mathbf{42}_6$ and $\mathbf{42}_8$ are switched off. Therefore, one end of the capacitor is connected to the first liquid-crystal drive potential supply line 28 via the fifth switch circuit $\mathbf{42}_5$. The other end of the capacitor 72 is connected to the center potential supply line 30 via the seventh switch circuit $42_7$ and electrically disconnected from the ground potential supply line 22.

Through the switching operations of the fifth to eighth switch circuits $42_5$ to $42_8$ caused by the second switch drive circuit 70, the center potential VC is applied to the ground potential supply line 22 at the first timing and when electric charge is stored, the potential level of the first liquid-crystal drive potential supply line 28 is set at the second timing based on the center potential supply line 30. According to this, the potential of the first liquid-crystal drive potential supply line 28 is twice as high as that of the center potential VC.

According to such a charge pump circuit, the capacitor 72 restricts the consumed current to the switching currents of the fifth to eighth switch circuits $42_5$ to $42_8$, so that the consumed current can be reduced. Regardless of the capacitance of the capacitor 72, the switching operations can provide a stepped-up potential twice the center potential VC.

Note that, like the first step-up circuit 12 shown in FIG. 5, the second step-up circuit 16 may have a capacitor connected between $ND_5$ and the first liquid-crystal drive potential supply line 28 and a capacitor connected between $ND_5$ and the ground potential supply line 22. In this case, the potential level can be stepped up to a double accurately.

Although the foregoing description has been given of the charge pump circuit that performs double boosting, the embodiments of the present invention are not limited to this particular type.

2.3.2 Example of Cross-Sectional Structure

Figure 9:
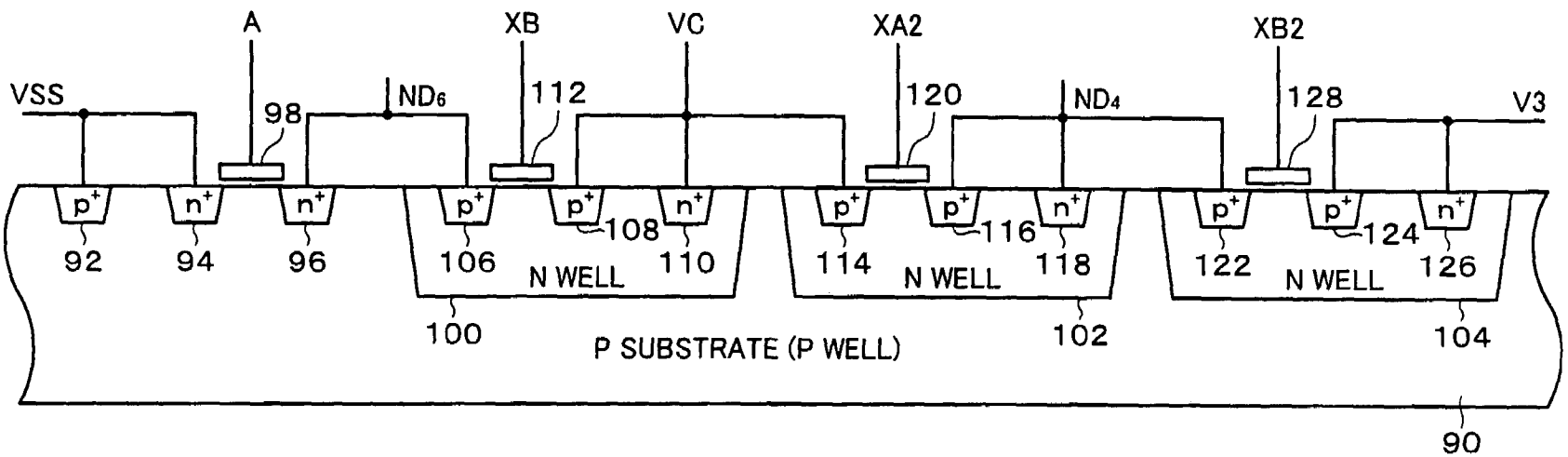
FIG. 9 is a cross-sectional view showing an example of a charge pump circuit formed on a substrate according to one embodiment of the present invention.

FIG. 9 shows an example of the cross-sectional structure of a charge pump circuit formed on a substrate.

First, with a p-type substrate 90 being a p well region, a high-concentration $p^+$ diffusion region 92 and high-concentration $n^+$ diffusion regions 94 and 96 are formed isolated from one another on the substrate 90, thereby forming an n-type (second conductivity type) (MOS) transistor or the eighth switch circuit $42_8$. Specifically, a gate electrode 98 is formed over a channel region between the high-concentration $n^+$ diffusion regions 94 and 96. The high-concentration $p^+$ diffusion region 92 and the high-concentration $n^+$ diffusion region 94 are electrically connected to the ground potential supply line 22. The switch drive signal A is applied to the gate electrode 98. The high-concentration $n^+$ diffusion region 96 serves as $ND_6$.

Also formed on the p-type substrate 90 are n well regions 100, 102 and 104 in which p-type (MOS) transistors which are the seventh, sixth and fifth switch circuits $42_7$, $42_6$ and $42_5$ are respectively formed.

More specifically, high-concentration $p^+$ diffusion regions 106 and 108 and a high-concentration $n^+$ diffusion region 110 are formed isolated from one another in the n well regions 100. A gate electrode 112 is formed over a channel region between the high-concentration $p^+$ diffusion regions 106 and 108. The high-concentration $p^+$ diffusion region 106 is electrically connected to the high-concentration $n^+$ diffusion region 96. The high-concentration $p^+$ diffusion region 108 and the high-concentration $n^+$ diffusion region 110 are electrically connected to the center potential supply line 30. The switch drive signal XB is applied to the gate electrode 112.

High-concentration $p^+$ diffusion regions 114 and 116 and a high-concentration $n^+$ diffusion region 118 are formed isolated from one another in the n well regions 102. A gate electrode 120 is formed over a channel region between the high-concentration $p^+$ diffusion regions 114 and 116. The high-concentration $p^+$ diffusion region 114 is electrically connected to the center potential supply line 30. The high-concentration $p^+$ diffusion region 116 and the high-concentration $n^+$ diffusion region 118 are electrically connected together to serve as $ND_4$. The switch drive signal XA2 is applied to the gate electrode 120.

High-concentration $p^+$ diffusion regions 122 and 124 and a high-concentration $n^+$ diffusion region 126 are formed isolated from one another in the n well regions 104. A gate electrode 128 is formed over a channel region between the high-concentration $p^+$ diffusion regions 122 and 124. The high-concentration $p^+$ diffusion region 122 is electrically connected to $ND_4$. The high-concentration $p^+$ diffusion region 124 and the high-concentration $n^+$ diffusion region 126 are electrically connected to the first liquid-crystal drive potential supply line 28 to which the potential level V3 is supplied. The switch drive signal XB2 is applied to the gate electrode 128.

This structure can allow the charge pump circuit shown in FIG. 9 to be formed on the p-type (first conductivity type) substrate that has a twin-well structure.

Although the charge pump circuit is formed by the twin-well structure formed on the p-type substrate in FIG. 9, the design is not restrictive but the charge pump circuit shown in FIG. 8 may be formed by a twin-well structure formed on an n-type substrate. In this case, p type and n type in FIG. 9 should be reversed and the logic levels of the switch drive signals A, XB, XA2 and XB2 should be inverted.

2.4 Multipotential Generating Circuit 2.4.1 Structural Example

In a multipotential generating circuit 18 according to the embodiments of the present invention, a resistor element 74 which can perform resistive division at an arbitrary ratio is connected between the first liquid-crystal drive potential supply line 28 and the center potential supply line 30, as shown in FIG. 8. Further, a resistor element 76 which can perform resistive division at an arbitrary ratio is connected between the center potential supply line 30 and the ground potential supply line 22.

Each of the resistor elements 74 and 76 is divided into three parts at an arbitrary ratio, and the positive terminals of voltage-follower connected operational amplifier circuits 78, 80, 82 and 84 are connected to the respective resistive-division originated potential levels. More specifically, the output terminal of the operational amplifier circuit 78 is connected in feedback fashion to the negative terminal thereof and further connected to the second liquid-crystal drive potential supply line 32 to which the potential level V2 is supplied. The output terminal of the operational amplifier circuit 80 is connected in feedback fashion to the negative terminal thereof and further connected to the third liquid-crystal drive potential supply line 34 to which the potential level V1 is supplied. The output terminal of the operational amplifier circuit 82 is connected in feedback fashion to the negative terminal thereof and further connected to the fourth liquid-crystal drive potential supply line 36 to which the potential level MV1 is supplied. The output terminal of the operational amplifier circuit 84 is connected in feedback fashion to the negative terminal thereof and further connected to the fifth liquid-crystal drive potential supply line 38 to which the potential level MV2 is supplied.

2.4.2 Set Potentials

In case of the MLS driving scheme, the potential levels V3, MV3 (VSS) and VC which are supplied to the first liquid-crystal drive potential supply line 28, the ground potential supply line 22 and the center potential supply line 30 are regulated in such a way as to have the following relationship.

In case of FIG. 2, for example, let $V_{ON(RMS)}$ be the root-mean-square voltage in one frame when a pixel is on and $V_{OFF(RMS)}$ be the root-mean-square voltage in one frame when a pixel is off.

As the potential difference between the scan electrode and signal electrode is applied to each pixel, the root-mean-square voltage $V_{ON(RMS)}$ in the MLS driving scheme that selects four lines simultaneously can be expressed as the following equation (2).

$$V_{ON(\mathrm{RMS})} = \sqrt{\frac{3v_3^2 + (v_3 + v_2)^2 + (N-4)v_1{}^2}{N}} \tag{2}$$

Similarly, the root-mean-square voltage $V_{OFF(RMS)}$ in the MLS driving scheme that selects four lines simultaneously can be expressed as the following equation (3).

$$V_{OFF(\mathrm{RMS})} = \sqrt{\frac{3v_3^2 + (v_3 - v_2)^2 + (N-4)v_1{}^2}{N}} \tag{3}$$

In those two equations, $v_3$, $v_2$ and $v_1$ are respectively potential differences between the potential levels V3, V2 and V1 and the center potential VC. $v_3$, $v_2$ and $v_1$ are respectively equivalent to potential differences between the potential levels V3, V2 and V1 and the center potential VC. Further, N is the number of display lines.

As $v_1$ is expressed by an equation (5) by using a bias ratio given by an equation (4), $V_{ON(RMS)}/V_{OFF(RMS)}$ becomes as given by an equation (6)

$$a = v_2/v_3 \tag{4}$$

$$v_1 = v_3/2a \tag{5}$$

$$\frac{V_{ON(\mathrm{RMS})}}{V_{OFF(\mathrm{RMS})}} = \sqrt{\frac{3(2a+1)^2 + (2a-1)^2 + (N-4)}{3(2a-1)^2 + (2a+1)^2 + (N-4)}} \tag{6}$$

The ratio given by the equation (6) is also equivalent to the ratio of the brightness of a pixel which is on to the brightness of a pixel which is off or a contrast ratio. When the numerator, $V_{ON(RMS)}$, in the equation (6) becomes large and the denominator, $V_{OFF(RMS)}$, becomes small, the value of the equation (6) becomes a maximum. That is, when the equation (6) takes the maximum value, the bias ratio a becomes optimal. Differentiating the equation (6) to acquire a limit, we obtain the optimal bias ration as given by an equation (7).

$$a = \pm\frac{\sqrt{N}}{4} \tag{7}$$

Apparently, the contrast of the liquid crystal display can be maximized by determining the potential levels V1 (MV1), V2 (MV2) and V3 (MV3) by adjusting the resistor dividing points of the resistor elements 74 and 76 in such a way as to provide $v_1$, $v_2$ and $v_3$ as indicated by the equation (7) based on the display line number N.

2.4.3 Voltage-Follower Connected Operational Amplifier Circuit

The multipotential generating circuit 18 has the voltage-follower connected operational amplifier circuits 78, 80, 82 and 84 connected to the resistor dividing points of the resistor elements 74 and 76. This structure requires that the resistor elements 74 and 76 should have high resistances in order to reduce the consumption power. When the resistive-division originated potentials are applied as they are to the liquid crystal driving electrodes, however, the output impedance becomes high, which increases a variation at the time the liquid crystal is driven. This lowers the display quality of the liquid crystal. In this respect, the voltage-follower connected operational amplifier circuits as impedance converting means are connected to the resistor dividing points, thus lowering the output impedance. Even in case where the resistor elements 74 and 76 have high resistances, therefore, the display quality of the liquid crystal will not be lowered.

(a) Structure

Figure 10:
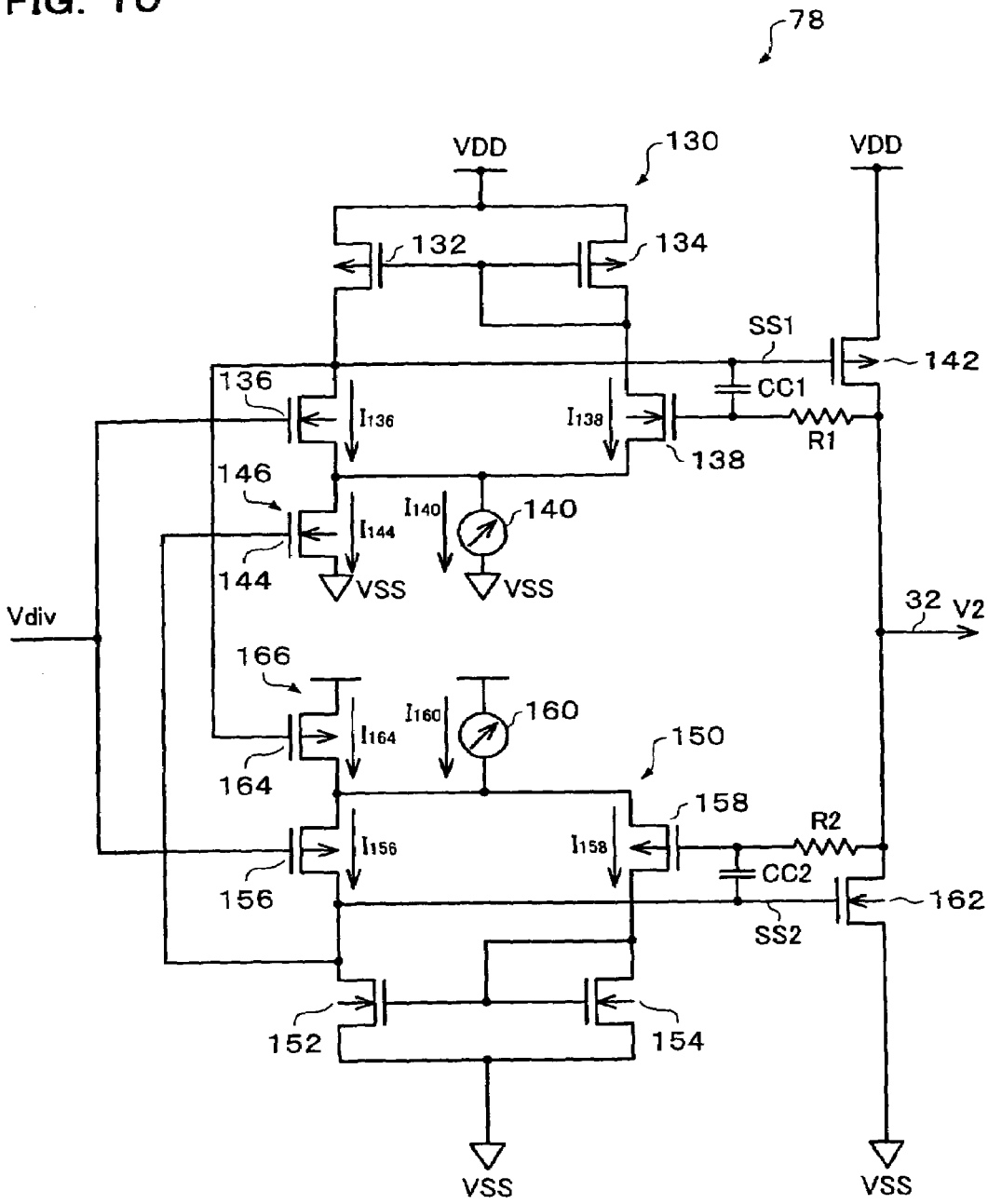
FIG. 10 is a circuit diagram showing a structure of a voltage-follower connected operational amplifier circuit according to the embodiment of the present invention.

FIG. 10 shows an example of a structure of the voltage-follower connected operational amplifier circuit 78.

Although the following discusses the voltage-follower connected operational amplifier circuit (voltage-follower type operational amplifier circuit) 78, the voltage-follower type operational amplifier circuits 80, 82 and 84 have the same structure.

The voltage-follower type operational amplifier circuit 78, which is connected to one resistor dividing point of the resistor element 74, includes voltage-follower type first and second differential amplifier circuits 130 and 150 that operate on a resistive-division originated potential level Vdiv between the potential level V3 and the center potential VC as a common input.

The voltage-follower type first differential amplifier circuit (or a first conductivity type differential amplifier circuit) 130 includes a p-type transistor 132 and a p-type transistor 134 which, together with the p-type transistor 132, constitutes a current mirror. The p-type transistors 132 and 134 have the same size and same performance and constitute a current mirror circuit.

The first differential amplifier circuit 130 further has an n-type transistor 136 connected in series to the p-type transistor 132 between the power-supply level VDD and the ground level VSS, and an n-type transistor 138 connected in series to the p-type transistor 134 between the power-supply level VDD and the ground level VSS. The n-type transistors 136 and 138 are connected to the ground level VSS via a constant current source 140. The n-type transistors 136 and 138 are designed to have different sizes that give a performance difference.

The voltage-follower type second differential amplifier circuit (or a second conductivity type differential amplifier circuit) 150 includes an n-type transistor 152 and an n-type transistor 154 which, together with the n-type transistor 152, constitutes a current mirror. The n-type transistors 152 and 154 have the same size and same performance and constitute a current mirror circuit.

The second differential amplifier circuit 150 further has a p-type transistor 156 connected in series to the n-type transistor 152 between the power-supply level VDD and the ground level VSS, and a p-type transistor 158 connected in series to the n-type transistor 154 between the power-supply level VDD and the ground level VSS. The p-type transistors 156 and 158 are connected to the power-supply level VDD via a constant current source 160. The p-type transistors 156 and 158 are designed to have different sizes that give a performance difference.

A differential output signal is output as a first signal SS1 from the node between the p-type transistor 132 and the n-type transistor 136 of the first differential amplifier circuit 130 and a p-type transistor 142 operates based on the differential output signal.

A differential output signal is output as a second signal SS2 from the node between the n-type transistor 152 and the p-type transistor 156 of the second differential amplifier circuit 150 and an n-type transistor 162 operates based on the differential output signal.

The p-type transistor 142 and the n-type transistor 162 are connected in series between the power-supply level VDD and the ground level VSS. The commonly connected drains of the p-type transistor 142 and the n-type transistor 162 are connected to the second liquid-crystal drive potential supply line 32 which supplies the potential level V2.

The first and second differential amplifier circuits 130 and 150 are respectively provided with oscillation preventing capacitors CC1 and CC2 and electrostatic protecting resistors R1 and R2.

The first differential amplifier circuit 130 includes a first current control circuit 146 having an n-type transistor 144 connected in parallel to the constant current source 140. The second signal SS2 which is the differential output signal of the second differential amplifier circuit 150 is supplied to the gate electrode of the n-type transistor 144. The first current control circuit 146 controls the gate voltage of the p-type transistor 142 by controlling the first signal SS1 by controlling the value of the constant current in the first differential amplifier circuit 130.

Similarly, the second differential amplifier circuit 150 includes a second current control circuit 166 having a p-type transistor 164 connected in parallel to the constant current source 160. The first signal SS1 which is the differential output signal of the first differential amplifier circuit 130 is supplied to the gate electrode of the p-type transistor 164. As a result the second current control circuit 166 controls the gate voltage of the n-type transistor 162 by controlling the second signal SS2 by controlling the value of the constant current in the second differential amplifier circuit 150.

When the output potential level V2 of the operational amplifier circuit 78 is stable, the n-type transistor 144 and the p-type transistor 164 are turned off, so that the current hardly flows.

(b) Description of Operation

The voltage-follower connected operational amplifier circuit according to the embodiments of the present invention has low consumption power and can cause the output potential level to quickly shift to a stable state.

(b-1) In Case Where the Output Potential Level is Lower than the Stable State

When the output potential level is lower than the stable state, the gate voltages of the n-type transistor 138 and the p-type transistor 158 become lower than the natural voltages in the stable state.

In the first differential amplifier circuit 130, while a constant current flows from the constant current source 140, the gate voltage of the n-type transistor 138 falls. Therefore, a current $I_{138}$ that flows through the n-type transistor 138 decreases and a current $I_{136}$ that flows through the n-type transistor 136 increases accordingly.

As a result, the voltage of the first signal SS1 drops, increasing the current that flows through the p-type transistor 142 in the first differential amplifier circuit 130.

In the second differential amplifier circuit 150, by way of contrast, a constant current flows from the constant current source 160 and the sum of currents $I_{156}$ and $I_{158}$ that flow through the p-type transistors 156 and 158 which constitute a differential pair is constant. As the gate voltage of the p-type transistor 158 falls, the current $I_{158}$ that flows through the p-type transistor 158 increases and the current $I_{156}$ that flows through the p-type transistor 156 decreases accordingly.

As a result, the voltage of the second signal SS2 drops, reducing the current that flows through the n-type transistor 162 in the second differential amplifier circuit 150.

The output potential level V2 of the operational amplifier circuit 78 rises toward the stable state in this manner.

The gate voltage of the p-type transistor 142 is determined by the charges stored in the gate capacitance, the oscillation preventing capacitor CC1 and a parasitic capacitor of the gate line to which the first signal SS1 is supplied. Similarly, the gate voltage of the n-type transistor 162 is determined by the charges stored in the gate capacitance, the oscillation preventing capacitor CC2 and a parasitic capacitor of the gate line to which the second signal SS2 is supplied. Therefore, the time for charging the charges slows the response to a change in gate voltage. To cope with it, the first and second current control circuits 146 and 166 improve the response to a change in the gate voltage of each transistor.

Specifically, as the current $I_{156}$ that flows through the p-type transistor 156 in the second differential amplifier circuit 150 decreases, the second signal SS2 whose voltage has dropped is applied to the gate electrode of the n-type transistor 144 in the first differential amplifier circuit 130. As a result, a current $I_{144}$ that flows through the n-type transistor 144 decreases, so that the first signal SS1 or the gate voltage of the p-type transistor 142 is determined by the current that flows through the constant current source 140.

As the first signal SS1 falls in the first differential amplifier circuit 130, on the other hand, a current $I_{164}$ that flows through the p-type transistor 164 in the second differential amplifier circuit 150 increases. As a result, the current that flows in the differential pair and the current mirror circuit in the second differential amplifier circuit 150 increases. This is equivalent to the case where the constant current value for driving the differential amplifier circuit has increased, and the operation of the n-type transistor 162 can be made faster as a consequence.

It is therefore possible to shorten the time for the output potential level V2 of the operational amplifier circuit 78 to increase and shift to the stable state.

Particularly, the steady currents provided by the constant current sources 140 and 160 increase the consumed current. Therefore, the consumed power of the operational amplifier circuit can be reduced by setting the constant current values of the constant current sources 140 and 160 as small as possible and supplying the current with the optimal value only at the time of providing the required stable output.

Further, the n-type transistors 136 and 138 in the first differential amplifier circuit 130, which constitute a differential pair, have different performances. It is assumed in the following description that, for example, the performance of the n-type transistor 138 is higher than the performance of the n-type transistor 136.

In this case, in the stable state where the same current flows, the gate-source voltage of the n-type transistor 138 can be lower than the gate-source voltage of the n-type transistor 136. In case where the outputs of the first and second differential amplifier circuits 130 and 150 are short-circuited, however, the gate-source voltages of the n-type transistors 136 and 138 become equal to each other. Although the n-type transistor 138 is capable of allowing a larger current to flow, the same current flows in the n-type transistors 136 and 138. In this case, the gate potentials of the p-type transistors 132 and 134 become lower, thus raising the potential of the first signal SS1. This means that the gate-source voltage of the p-type transistor 142 becomes lower, so that the current which flows through the p-type transistor 142 can be reduced.

Assuming that the p-type transistors 156 and 158 in the second differential amplifier circuit 150, which constitute a differential pair, have different performances and the performance of the p-type transistor 158 is higher than the performance of the p-type transistor 156, the gate-source voltage of the p-type transistor 158 can be lower than the gate-source voltage of the p-type transistor 156 in the stable state where the same current flows. In case where the outputs of the first and second differential amplifier circuits 130 and 150 are short-circuited, however, the gate-source voltages of the p-type transistors 156 and 158 become equal to each other. Although the p-type transistor 158 is capable of allowing a larger current to flow, the same current flows in the p-type transistors 156 and 158. In this case, the gate potentials of the n-type transistors 152 and 154 become lower, thus dropping the potential of the second signal SS2. This means that the gate-source voltage of the n-type transistor 162 becomes lower, so that the current which flows through the n-type transistor 162 can be reduced.

Because the output of the first differential amplifier circuit 130 as a p-type differential amplifier circuit which operates on the common input and the output of the second differential amplifier circuits 150 as an n-type differential amplifier circuit which operates on the common input are short-circuited and transistors having different performances constitute a differential pair, the current consumption can be reduced.

(b-2) In Case Where the Output Potential Level is Higher than the Stable State

When the output potential level is higher than the stable state, the gate voltages of the n-type transistor 138 and the p-type transistor 158 become higher than the natural voltages in the stable state.

In the first differential amplifier circuit 130, while a constant current flows from the constant current source 140, the gate voltage of the n-type transistor 138 rises. Therefore, a current $I_{138}$ that flows through the n-type transistor 138 increases and a current $I_{136}$ that flows through the n-type transistor 136 decreases accordingly.

As a result, the voltage of the first signal SS1 rises, reducing the current that flows through the p-type transistor 142 in the first differential amplifier circuit 130.

In the second differential amplifier circuit 150, by way of contrast, as the gate voltage of the p-type transistor 158 rises, the current $I_{158}$ that flows through the p-type transistor 158 decreases and the current $I_{156}$ that flows through the p-type transistor 156 increases accordingly.

As a result, the voltage of the second signal SS2 rises, increasing the current that flows through the n-type transistor 162 in the second differential amplifier circuit 150.

The output potential level V2 of the operational amplifier circuit 78 drops toward the stable state in this manner.

As the current $I_{156}$ that flows through the p-type transistor 156 in the second differential amplifier circuit 150 increases, the second signal SS2 whose voltage has increased is applied to the gate electrode of the n-type transistor 144 in the first differential amplifier circuit 130. As a result, the current $I_{144}$ that flows through the n-type transistor 144 increases, so that the current that flows in the differential pair and the current mirror circuit in the first differential amplifier circuit 130 increases. This is equivalent to the case where the constant current value for driving the differential amplifier circuit has increased, and the operation of the p-type transistor 142 can be made faster as a consequence.

As the first signal SS1 rises in the first differential amplifier circuit 130, on the other hand, the current $I_{164}$ that flows through the p-type transistor 164 in the second differential amplifier circuit 150 decreases. At this time, the second signal SS2 that is the gate voltage of the n-type transistor 162 is determined by the current flowing in the constant current source 160.

It is therefore possible to shorten the time for the output potential level V2 of the operational amplifier circuit 78 to drop and shift to the stable state.

In this case too, as mentioned above, the current consumption can be reduced as the outputs of the first and second differential amplifier circuits 130 and 150 which operate on the common input are short-circuited and transistors having different performances constitute a differential pair.

Figure 11:
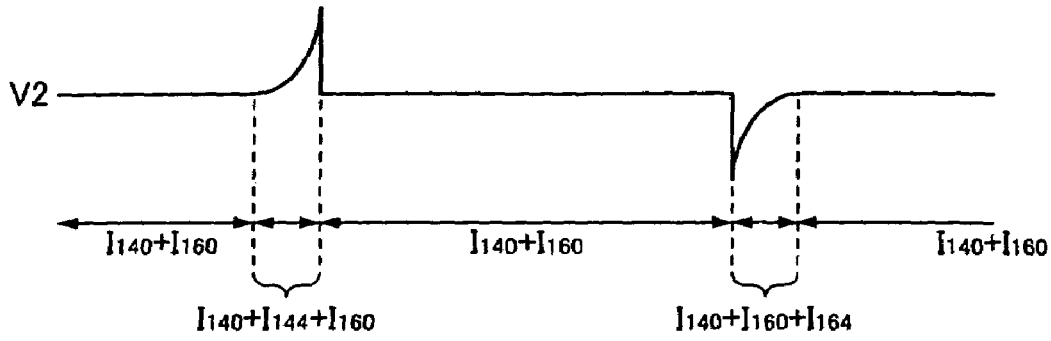
FIG. 11 illustrates an example of operation of the operational amplifier circuit shown in FIG. 10.

FIG. 11 shows one example of the operation of the operational amplifier circuit 78 shown in FIG. 10.

As described above, when the output potential level V2 of the operational amplifier circuit 78 shifts to the positive side from the stable potential level, the current $I_{144}$ that flows through the n-type transistor 144 of the first differential amplifier circuit 130 increases to set the output potential level V2 back to the stable state. When the output potential level V2 shifts to the negative side from the stable potential level, the current $I_{164}$ that flows through the p-type transistor 164 of the second differential amplifier circuit 150 increases to set the output potential level V2 back to the stable state.

While the consumed current of the operational amplifier circuit 78 is merely the sum of currents $I_{140}$ and $I_{160}$ that are provided by the constant current sources 140 and 160 in the stable state, the current $I_{144}$ that is provided by the n-type transistor 144 and the current $I_{164}$ that is provided by the p-type transistor 164 are respectively added to the currents $I_{140}$ and $I_{160}$ when the instable state is returned to the stable state, thus quickening the transition to the stable state. At this time, the smaller $I_{140}$ and $I_{160}$ in the stable state, the more the whole consumed current of the operational amplifier circuit 78 can be reduced.

As described above, based on the ground level VSS, the power supply circuit according to the embodiments of the present invention generates potentials of plural levels with the center potential VC being the potential obtained by regulating the first stepped-up potential level VOUT acquired by stepping up the power-supply potential level. The regulator circuit as potential regulating means does not require a high withstand voltage characteristic and an inexpensive process can be used. In case where a twin-well process which can ensure cost reduction is used, potential levels only on the positive side to the ground level VSS can be generated. This eliminates the need for external parts that would have been required in the related art and can avoid a mounting problem while realizing the cost reduction of the apparatus.

3. First Modification

The multipotential generating circuit which is applied to the power supply circuit is not limited to the one shown in FIG. 8.

Figure 12:
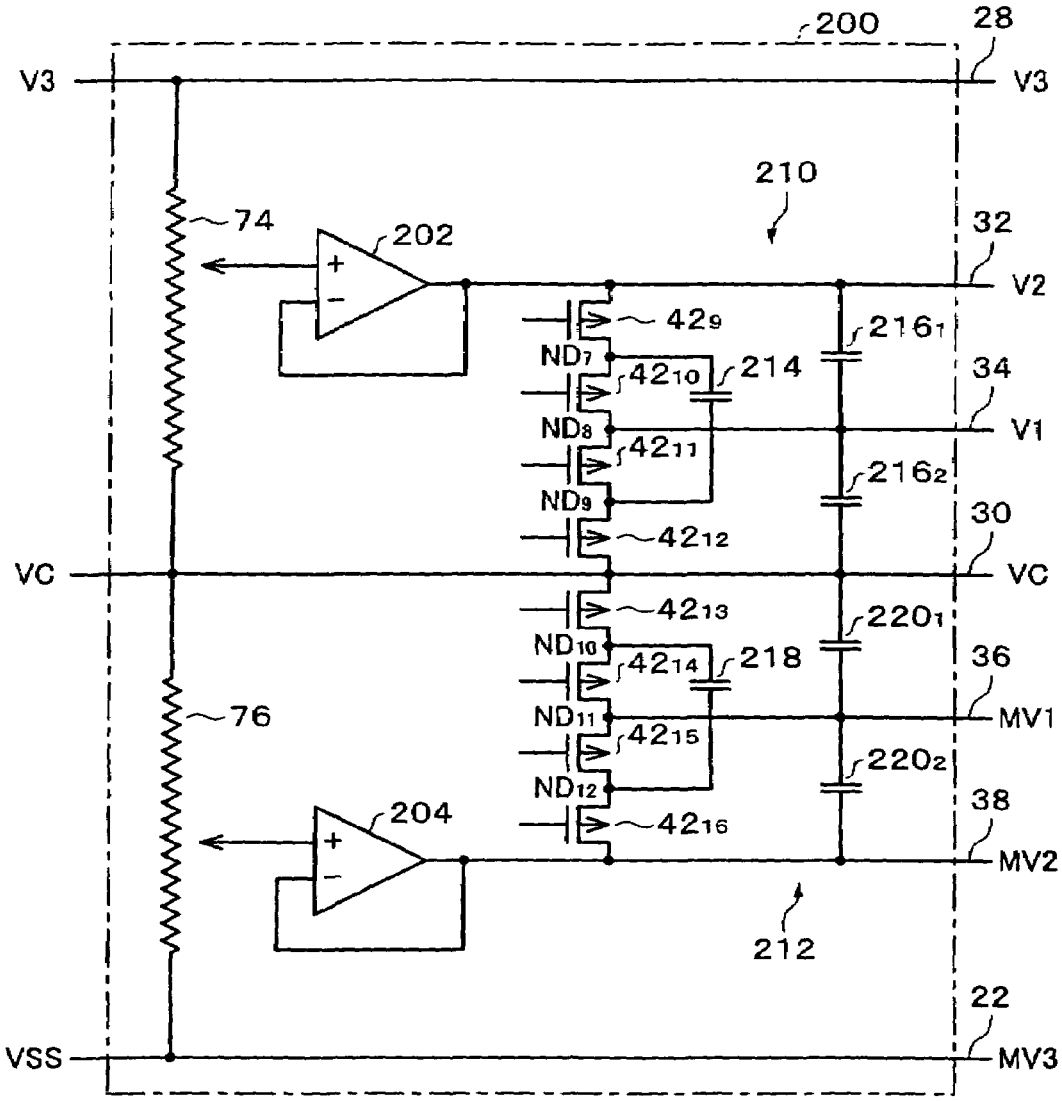
FIG. 12 is a circuit diagram schematically showing a structure of a multipotential generating circuit according to a first modification of the present invention.

FIG. 12 schematically shows a structure of a multipotential generating circuit according to a first modification of the present invention.

Note that components that are the same as those in the multipotential generating circuit 18 shown in FIG. 8 are denoted by the same reference numbers, and further description thereof is omitted.

A multipotential generating circuit 200 according to the first modification has voltage-follower type operational amplifier circuits 202 and 204 of the type shown in FIG. 10 connected to the resistor dividing points of the resistor elements 74 and 76 that are so set as to satisfy the equation (7).

The output terminal of the operational amplifier circuit 202 is connected to the second liquid-crystal drive potential supply line 32 which supplies the potential level V2 directly. The output terminal of the operational amplifier circuit 204 is connected to the fifth liquid-crystal drive potential supply line 38 which supplies the potential level MV2 directly.

In the multipotential generating circuit 200 according to the first modification, step-down (or debooster) circuits 210 and 212 are respectively provided between the center potential supply line 30 and the second liquid-crystal drive potential supply line 32 and between the center potential supply line 30 and the fifth liquid-crystal drive potential supply line 38.

Specifically, the step-down (or debooster) circuit 210 includes ninth to twelfth switch circuits $\mathbf{42}_9$ to $\mathbf{42}_{12}$ connected in series between the second liquid-crystal drive potential supply line 32 and the center potential supply line 30, and a switch drive circuit (not shown) which switches on or off the ninth to twelfth switch circuits $\mathbf{42}_9$ to $\mathbf{42}_{12}$.

Given that $ND_7$ to $ND_9$ are nodes between the ninth to twelfth switch circuits $\mathbf{42}_9$ to $\mathbf{42}_{12}$, the step-down circuit 210 includes a capacitor 214 connected between $ND_7$ and $ND_9$, a capacitor $\mathbf{216}_1$ connected between the second liquid-crystal drive potential supply line 32 and $ND_8$, and a capacitor $\mathbf{216}_2$ connected between $ND_8$ and the center potential supply line 30.

$ND_8$ is connected to the third liquid-crystal drive potential supply line 34 to which the potential level V1 is supplied.

The unillustrated switch drive circuit drives the ninth to twelfth switch circuits $\mathbf{42}_9$ to $\mathbf{42}_{12}$ in such a way that the ON duration of the ninth and eleventh switch circuits $\mathbf{42}_9$ and $\mathbf{42}_{11}$ and the ON duration of the tenth and twelfth switch circuits $\mathbf{42}_{10}$ and $\mathbf{42}_{12}$ are alternately repeated.

While the ninth to twelfth switch circuits $\mathbf{42}_9$ to $\mathbf{42}_{12}$ can be constituted by p-type (first conductivity type) MOS transistors, they may be constituted by n-type MOS transistors. That is, any circuit that has a switching capability can be used for those switch circuits.

As the individual switch drive signals for the step-down circuit 210 are the same as those generated by the first switch drive circuit 44 shown in FIG. 6, their description will not be repeated.

According to the step-down circuit 210, as the first timing and second timing are alternately repeated, the charges to be stored in the capacitors 214, $\mathbf{216}_1$ and $\mathbf{216}_2$ become stable so that the values of the voltages to be applied to the individual both ends of the capacitors 214, $\mathbf{216}_1$ and $\mathbf{216}_2$ become equal to one another. As a result, the potential of the intermediate point between the capacitors $\mathbf{216}_1$ and $\mathbf{216}_2$ or the potential level V1 converges to the intermediate potential between the potential level V2 of the second liquid-crystal drive potential supply line 32 and the center potential VC.

Similarly, the step-down (or debooster) circuit 212 includes thirteenth to sixteenth switch circuits $\mathbf{42}_{13}$ to $\mathbf{42}_{16}$ connected in series between the center potential supply line 30 and the fifth liquid-crystal drive potential supply line 38, and a switch drive circuit (not shown) which switches on or off the thirteenth to sixteenth switch circuits $\mathbf{42}_{13}$ to $\mathbf{42}_{16}$.

Given that $ND_{10}$ to $ND_{12}$ are nodes between the thirteenth to sixteenth switch circuits $\mathbf{42}_{13}$ to $\mathbf{42}_{16}$, the step-down circuit 212 includes a capacitor 218 connected between $ND_{10}$ and $ND_{12}$, a capacitor $\mathbf{220}_1$ connected between the center potential supply line 30 and $ND_{11}$, and a capacitor $\mathbf{220}_2$ connected between $ND_{11}$ and the second liquid-crystal drive potential supply line 32.

$ND_{11}$ is connected to the fourth liquid-crystal drive potential supply line 36 to which the potential level MV1 is supplied.

The unillustrated switch drive circuit drives the thirteenth to sixteenth switch circuits $\mathbf{42}_{13}$ to $\mathbf{42}_{16}$ in such a way that the ON duration of the thirteenth and fifteenth switch circuits $\mathbf{42}_{13}$ and $\mathbf{42}_{15}$ and the ON duration of the fourteenth and sixteenth switch circuits $\mathbf{42}_{14}$ and $\mathbf{42}_{16}$ are alternately repeated.

While the thirteenth to sixteenth switch circuits $\mathbf{42}_{13}$ to $\mathbf{42}_{16}$ can be constituted by p-type (first conductivity type) MOS transistors, they may be constituted by n-type MOS transistors. That is, any circuit that has a switching capability can be applied to those switch circuits.

As the individual switch drive signals for the step-down circuit 212 are the same as those generated by the first switch drive circuit 44 shown in FIG. 6, their description will be omitted.

According to the step-down circuit 212, as the first timing and second timing are alternately repeated, the charges to be stored in the capacitors 218, $\mathbf{220}_1$ and $\mathbf{220}_2$ become stable so that the values of the voltages to be applied to the individual both ends of the capacitors 218, $\mathbf{220}_1$ and $\mathbf{220}_2$ become equal to one another. As a result, the potential of the intermediate point between the capacitors $\mathbf{220}_1$ and $\mathbf{220}_2$ or the potential level MV1 converges to the intermediate potential between the center potential VC and the potential level MV2 of the fifth liquid-crystal drive potential supply line 38.

Those step-down circuits eliminate the currents that flow across the capacitors, and thus leave only the currents that are used for the switching operations. This can reduce the consumed current. Even in case where the capacitances of the capacitors vary, the intermediate potential can be generated precisely. It is also possible to reduce the number of operational amplifier circuits in use.

4. Second Modification

Figure 13:
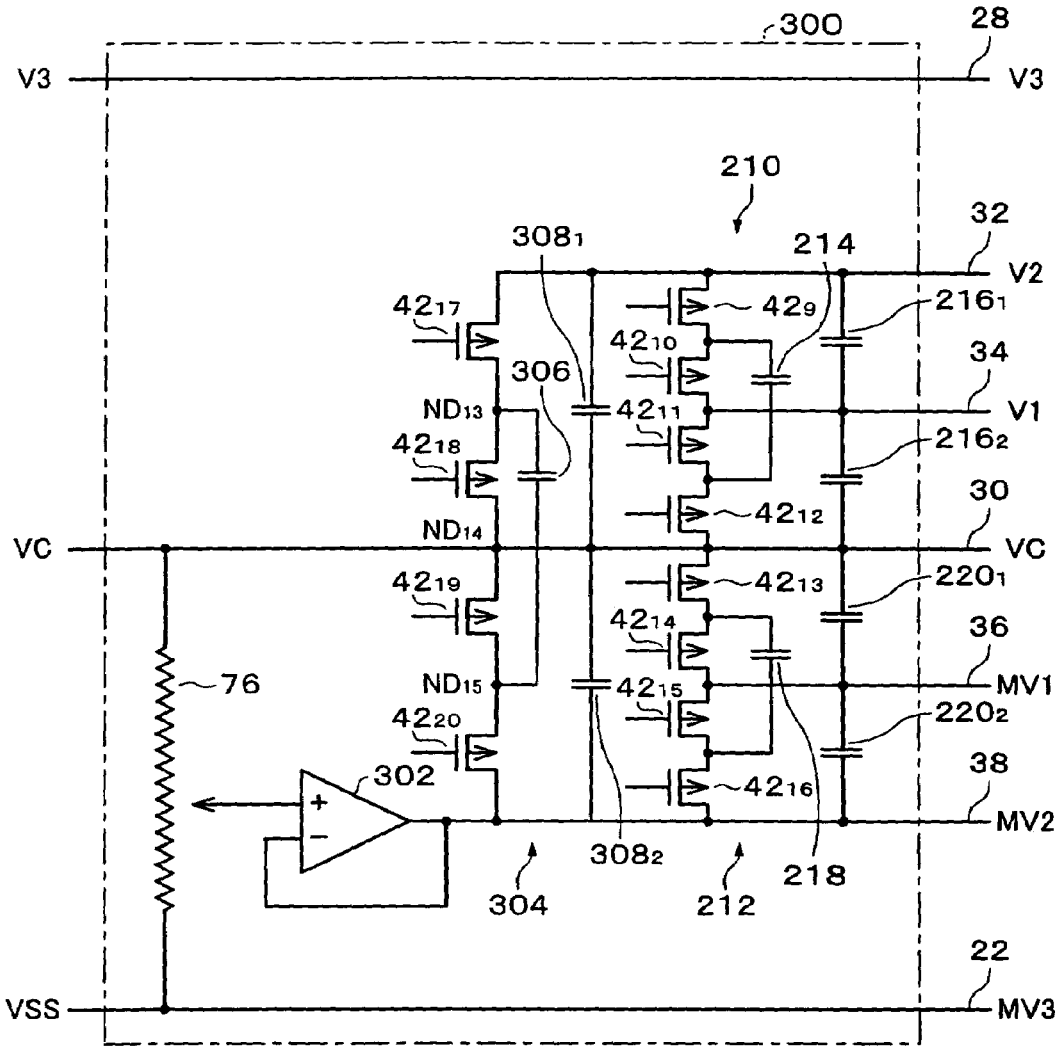
FIG. 13 is a circuit diagram schematically showing a structure of a multipotential generating circuit according to a second modification of the present invention.

FIG. 13 schematically shows a structure of a multipotential generating circuit according to a second modification of the present invention.

Note that components that are the same as those in the multipotential generating circuit 18 in FIG. 8 and the multipotential generating circuit 200 in FIG. 12 are denoted by the same reference numbers, and further description thereof is omitted.

A multipotential generating circuit 300 according to the second modification has a voltage-follower type operational amplifier circuit 302 of the type shown in FIG. 10 connected to the resistor dividing point of the resistor element 76 that is so set as to satisfy the equation (7). Note that the potential difference between the potential level V2 and the center potential VC is equivalent to the potential difference between the potential level MV2 and the center potential VC.

The output terminal of the operational amplifier circuit 302 is connected to the fifth liquid-crystal drive potential supply line 38 which supplies the potential level MV2 directly.

The multipotential generating circuit 300 according to the second modification includes a step-up circuit 304 which generates the potential level V2 by performing double boosting illustrated in FIG. 5 based on the potential level MV2 supplied to the fifth liquid-crystal drive potential supply line 38, and the step-down circuits 210 and 212 shown in FIG. 12.

The step-up circuit 304 generates the potential level V2 by stepping up the potential difference between the center potential VC and the potential level MV2 twice. The step-down circuit 210 generates, as the potential level V1, the intermediate potential of the potential difference between the potential level V2 and the center potential VC. The step-down circuit 212 generates, as the potential level MV1, the intermediate potential of the potential difference between the potential level MV2 and the center potential VC.

More specifically, the step-up circuit 304 includes seventeenth to twentieth switch circuits $\mathbf{42}_{17}$ to $\mathbf{42}_{20}$ connected in series between the second liquid-crystal drive potential supply line 32 and the fifth liquid-crystal drive potential supply line 38, and a switch drive circuit (not shown) which turns on or off the seventeenth to twentieth switch circuits $\mathbf{42}_{17}$ to $\mathbf{42}_{20}$.

Given that $ND_{13}$ to $ND_{15}$ are nodes between the seventeenth to twentieth switch circuits $\mathbf{42}_{17}$ to $\mathbf{42}_{20}$, the step-up circuit 304 includes a capacitor 306 connected between $ND_{13}$ and $ND_{15}$, a capacitor $\mathbf{308}_1$ connected between the second liquid-crystal drive potential supply line 32 and $ND_{14}$, and a capacitor $\mathbf{308}_2$ connected between $ND_{14}$ and the second liquid-crystal drive potential supply line 32.

$ND_{14}$ is connected to the center potential supply line 30 to which the center potential VC is supplied.

The unillustrated switch drive circuit drives the seventeenth to twentieth switch circuits $\mathbf{42}_{17}$ to $\mathbf{42}_{20}$ in such a way that the ON duration of the seventeenth and nineteenth switch circuits $\mathbf{42}_{17}$ and $\mathbf{42}_{19}$ and the ON duration of the eighteenth and twentieth switch circuits $\mathbf{42}_{18}$ and $\mathbf{42}_{20}$ are alternately repeated.

While the seventeenth to twentieth switch circuits $\mathbf{42}_{17}$ to $\mathbf{42}_{20}$ can be constituted by p-type (first conductivity type) MOS transistors, they may be constituted by n-type MOS transistors. That is, any circuit that has a switching capability can be adopted to those switch circuits.

As the individual switch drive signals for the step-up circuit 304 are the same as those generated by the first switch drive circuit 44 shown in FIG. 6, their description will be omitted.

According to the step-up circuit 304, as the first timing and second timing are alternately repeated, the charges to be stored in the capacitors 306, $\mathbf{308}_1$ and $\mathbf{308}_2$ become stable so that the values of the voltages to be applied to the individual both ends of the capacitors 306, $\mathbf{308}_1$ and $\mathbf{308}_2$ become equal to one another. As a result, the potential level V2 that is determined by the voltage of the both ends of the capacitor $\mathbf{308}_1$ becomes the voltage of the both ends of the capacitor $\mathbf{308}_2$, causing the potential level V2 to converge.

Even this step-up circuit can generate seven power supply levels. In this case, the number of the voltage-follower type operational amplifier circuits can be decreased in addition to the advantage of the first modification.

Although the resistor element 76 is provided between the center potential supply line 30 and the ground potential supply line 22 in the second modification so that the resistive-division originated potential is output as MV2 from the voltage-follower type operational amplifier circuit 302, this design is not restrictive. For example, a resistor element may be provided between the center potential supply line 30 and the first liquid-crystal drive potential supply line 28 so that the resistive-division originated potential is output as V2 from the voltage-follower type operational amplifier circuit 302, the potential level MV2 may be similarly generated by the step-up circuit, and the potential levels V1 and MV1 can be generated by the step-down circuits 210 and 212.

Note that the present invention is not limited to the above-described embodiments and the first and second modifications, and various other modifications can be made within the scope of the invention.

Although the embodiments and the first and second modifications have been described as generating seven power-supply levels, the number of the power-supply levels is not restrictive. For example, only one power-supply level equivalent to the center potential VC may be generated from the power-supply level VDD and the ground level VSS, or one or more power-supply levels may further be generated based on the power-supply level VDD, the ground level VSS or the center potential VC. Eight or more power-supply levels may be further generated.

The power supply circuit with the above-described structure can be applied for use in various electronic instruments including a liquid crystal device, such as a portable telephone, a game machine and a personal computer.

What is claimed is:

1. An operational amplifier circuit comprising:

a first conductivity type transistor having a gate to which a first differential output is supplied and a source to which a second potential is supplied;

a second conductivity type transistor having a gate to which a second differential output is supplied, a source to which a first potential is supplied and a drain which is connected to a drain of the first conductivity type transistor;

a first conductivity type differential amplifier circuit which generates the first differential output based on a difference between a given differential input potential and a potential at the drain of the first or second conductivity type transistor;

a second conductivity type differential amplifier circuit which generates the second differential output based on the difference between the differential input potential and the potential at the drain of the first or second conductivity type transistor;

a first current control circuit which controls a constant current value of the first conductivity type differential amplifier circuit based on the second differential output; and a second current control circuit which controls a constant current value of the second conductivity type differential amplifier circuit based on the first differential output, wherein in the first conductivity type differential amplifier circuit and the second conductivity type differential amplifier circuit, gates of transistors having different performances are respectively supplied with the predetermined differential input potential and the potential at the drain of the first or second conductivity type transistor, wherein the first current control circuit includes a first constant current source and a second conductivity type current transistor connected in parallel to the first constant current source, a gate of the second conductivity type current transistor being supplied with the second differential output, and wherein the second current control circuit includes a second constant current source and a first conductivity type current transistor connected in parallel to the second constant current source, a gate of the first conductivity type current transistor being supplied with the first differential output.

2. A power supply circuit comprising:

a voltage dividing circuit which divides a given potential; and the operational amplifier circuit as defined in claim 1 to which a potential divided by the voltage dividing circuit is supplied as the differential input potential.

3. A liquid crystal device comprising:

the power supply circuit as defined in claim 2;

a liquid crystal panel having a plurality of scan electrodes and a plurality of signal electrodes laid out in an intersecting manner;

a scan-electrode drive circuit which drives the scan electrodes upon reception of power from the power supply circuit; and a signal-electrode drive circuit which drives the signal electrodes upon reception of power from the power supply circuit.

4. An electronic instrument comprising the liquid crystal device as defined in claim 3.

* * * * *